US012636696B2

(12) United States Patent
Tanaka

(10) Patent No.: US 12,636,696 B2
(45) Date of Patent: May 26, 2026

(54) METHOD FOR MANUFACTURING PRESS FORMED ARTICLE AND PRESS FORMING DEVICE

(71) Applicant: JFE STEEL CORPORATION, Tokyo (JP)

(72) Inventor: Hiroyuki Tanaka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 349 days.

(21) Appl. No.: 18/022,913

(22) PCT Filed: Jul. 21, 2021

(86) PCT No.: PCT/JP2021/027336

§ 371 (c)(1),
(2) Date: Feb. 23, 2023

(87) PCT Pub. No.: WO2022/049916

PCT Pub. Date: Mar. 10, 2022

(65) Prior Publication Data

US 2023/0364664 A1 Nov. 16, 2023

(30) Foreign Application Priority Data

Sep. 3, 2020 (JP) ..... 2020-148121
Mar. 22, 2021 (JP) ..... 2021-047187

(51) Int. Cl.
*B21D 22/26* (2006.01)
*B21D 5/01* (2006.01)
(Continued)

(52) U.S. Cl.
CPC ..... *B21D 22/26* (2013.01); *B21D 5/01* (2013.01); *B21D 19/08* (2013.01); *B21D 22/02* (2013.01); *B21D 22/20* (2013.01); *B21D 22/30* (2013.01)

(58) Field of Classification Search
CPC . B21D 5/00; B21D 5/01; B21D 22/00; B21D 22/02; B21D 22/20; B21D 22/26; B21D 22/30; B21D 19/08; B21D 19/082
See application file for complete search history.

(56) References Cited

U.S. PATENT DOCUMENTS 10,022,764 B2 7/2018 Nishimura et al.
10,577,027 B2 3/2020 Ito
(Continued)

FOREIGN PATENT DOCUMENTS

CN 105188980 A 12/2015
CN 206139716 U 5/2017
(Continued)

OTHER PUBLICATIONS

May 13, 2024 extended Search Report issued in European Patent Application No. 21863974.8.
(Continued)

*Primary Examiner* — Jared O Brown
*Assistant Examiner* — Matthew Stephens
(74) *Attorney, Agent, or Firm* — Oliff PLC

(57) ABSTRACT

A press formed article is manufactured from a metal sheet, the press formed article including a top sheet portion, a vertical wall portion continuous to end portions in the width direction of the top sheet portion via a protruding ridge portion, and an outward flange portion continuous to longitudinal end portions of the top sheet portion, longitudinal end portions of the protruding ridge portion, and longitudinal end portions of the vertical wall portion via a recessed ridge portion. The metal sheet is bent at the position of the protruding ridge portion and formed into an L-shape in cross section, and then bent at the position of the recessed ridge portion and the outward flange portion is formed in a state where an area to be the outward flange portion is released.

19 Claims, 17 Drawing Sheets

(51) Int. Cl.

| | |
|---|---|
| ***B21D 19/08*** | (2006.01) |
| *B21D 22/02* | (2006.01) |
| *B21D 22/20* | (2006.01) |
| *B21D 22/30* | (2006.01) |

(56) References Cited

U.S. PATENT DOCUMENTS

| | | | | |
|---|---|---|---|---|
| 11,097,331 | B2 | 8/2021 | Tanaka et al. | |
| 11,311,925 | B2 | 4/2022 | Shirakami et al. | |
| 2015/0367392 | A1 | 12/2015 | Nishimura et al. | |
| 2018/0133778 | A1* | 5/2018 | Tanaka ..... | B21D 53/88 |
| 2019/0185070 | A1 | 6/2019 | Ito | |
| 2021/0220896 | A1 | 7/2021 | Shirakami et al. | |
| 2021/0323044 | A1 | 10/2021 | Tanaka et al. | |

FOREIGN PATENT DOCUMENTS

| | | | |
|---|---|---|---|
| CN | 109641259 | A | 4/2019 |
| EP | 2 946 848 | A1 | 11/2015 |
| GB | 1 257 065 | A | 12/1971 |
| JP | H05-023761 | A | 2/1993 |
| JP | 2007-029966 | A | 2/2007 |
| WO | 2014/148618 | A1 | 9/2014 |
| WO | 2016/194963 | A1 | 12/2016 |
| WO | 2018/104051 | A1 | 6/2018 |
| WO | 2019/216317 | A1 | 11/2019 |

OTHER PUBLICATIONS

Oct. 12, 2021 International Search Report issued in International Patent Application No. PCT/JP2021/027336.

Oct. 12, 2021 Written Opinion issued in International Patent Application No. PCT/JP2021/027336.

Mar. 7, 2023 International Preliminary Report on Patentability issued in International Patent Application No. PCT/JP2021/027336.

Nov. 15, 2022 Office Action issued in Japanese Patent Application No. 2022-546150.

Aug. 20, 2025 Office Action issued in Chinese Patent Application No. 202180054311.4.

Jan. 10, 2026 Office Action issued in Chinese Patent Application No. 202180054311.4 with concise statement of relevance.

* cited by examiner

METHOD FOR MANUFACTURING PRESS FORMED ARTICLE AND PRESS FORMING DEVICE

TECHNICAL FIELD

The present invention relates to a technology for manufacturing a saddle-shaped press formed article by press forming a metal sheet by a die.

The saddle-shaped press formed article includes: a top sheet portion; vertical wall portions continuous to end portions in the width direction of the top sheet portion via protruding ridge portions; and outward flange portions continuous to end portions of the top sheet portion in the longitudinal direction of the top sheet portion, end portions of the protruding ridge portions, and end portions of the vertical wall portions via recessed ridge portions.

BACKGROUND ART

A large number of pressed components including automobiles and home appliances are produced by transforming a flat metal sheet into various shapes. When mass-producing the pressed components, press forming (press working) has been widely used. The press forming is a working method for transforming a metal sheet using a press machine and a die incorporated in the press machine. In usual, a metal sheet before working is flat. Therefore, the transformation of the metal sheet into a complicated three-dimensional shape requires expansion and contraction of the metal sheet according to a target three-dimensional shape.

However, the more complicated the pressed component shape, the more difficult it is to expand and contract the metal sheet according to the three-dimensional shape. In particular, when a member difficult to form containing a high-tensile steel sheet, an aluminum alloy sheet, or the like having a tensile strength of 590 MPa or more and having poor ductility or a poor Lankford Value is adopted as the metal sheet, the above-described problems are likely to occur.

In the press forming, when the metal sheet cannot be expanded and contracted according to the three-dimensional shape, forming defects, such as cracks or wrinkles, are generated in the metal sheet. More specifically, when the metal sheet is transformed into a three-dimensional shape, the metal sheet has no choice but to expand in a site where the length of the metal sheet is insufficient and the shortage in length is not compensated from the surroundings. Then, when the metal sheet is stretched beyond the ductility of the metal sheet itself, cracks are generated. On the other hand, when the metal sheet is transformed into a three-dimensional shape, wrinkles tend to be generated in a case where the length of the metal sheet needs to be shortened or in a site where the metal sheet excessively flows from the surroundings.

Examples of a component shape difficult to achieve by press forming include a saddle-shaped press formed article. Saddle-shaped press forming article has outward flange portions formed continuously across a top sheet portion and vertical wall portions formed on both sides of the top sheet portion. The outward flange portions are flange portions on longitudinal end portions. When such a complicated component shape is formed from a flat metal sheet, tensile deformation or compression deformation is generated during the forming. Therefore, the pressed component is prone to cracks or wrinkles.

When a product having the above-described complicated shape is press formed from a metal sheet, bending working using a die containing a punch, a die, and a pad is performed, for example. At this time, there is a risk that an insufficient line length during the forming causes wrinkles in the flange portions positioned on the longitudinal end portions, which leads to forming defects in the working.

As a countermeasure for the problems, a method for manufacturing a saddle-shaped press formed article described in PTL 1 is mentioned, for example. In PTL 1, when the saddle-shaped press formed article is manufactured, a top sheet constituting part is bent, and, in the bending, a first force directed from the inside to the outside is applied to the top sheet constituting part. Further, PTL 1 describes applying a combined force of a second forces and a third force in a direction opposite to the first force, which are directed in directions facing each other, is applied to each of the outer surface sides of vertical wall constituting parts.

CITATION LIST

Patent Literature

PTL 1: WO 2019/216317

SUMMARY OF INVENTION

Technical Problem

The manufacturing method described in PTL 1 has problems that the die is complicated and the die cost is also high.

Herein, when the metal sheet is simply press formed in the manufacture of the press formed article having the outward flange portions formed continuously across the top sheet portion and the vertical wall portions, the following problems arise. More specifically, parts located at corner portions connecting a top sheet portion and vertical wall portions in the outward flange portions are subjected to tensile deformation. There is a risk that a strain concentrates on the parts, causing cracks in the corner portions. Therefore, conventionally, it has been impossible to increase the flange width of the corner portions in the outward flange portions, i.e., parts continuous to the longitudinal end portions of protruding ridge portions. Therefore, it has been necessary to reduce the width of the flange portions at the ridge portions by cut-out up to a formable width (see reference numeral 1Ec (position having a cutout) in FIG. 17).

In PTL 1, a pad movable up and down is added to the center of a top sheet portion of a lower die, and forming is performed in a state where the pad protrudes. Thus, a strain of the outward flange portions located in the longitudinal end portions is distributed to the top sheet portion by bending the top sheet constituting part in the metal sheet. However, PTL1 requires the addition of a mechanism of the protruding pad to the lower die. This complicates the die and increases the costs. Further, it is necessary to control the movement of the pad of the lower die, which reduces productivity.

The present invention has been made focusing on the above-described respects. It is an object of the present invention to form, by a die of a simpler configuration, a saddle-shaped press formed article having a top sheet portion, vertical wall portions, and outward flange portions formed across longitudinal end portions of the top sheet portion and the vertical wall portions.

Solution to Problem

The present inventors have variously examined a press forming method for a saddle-shaped press formed article having a top sheet portion, right and left vertical wall portions, and outward flange portions formed across longitudinal end portions of the top sheet portion and the vertical wall portions. Specifically, the present inventors have variously examined a press forming method capable of performing forming without cracking and not requiring a complicated die configuration. As a result of the examination, the following findings (1), (2) were obtained.

(1) A metal sheet is formed into a U-shape in cross section, and then, when outward flange portions are bent and raised, the forming of the flange portions is started from a top sheet portion and vertical wall portions. Thus, the strain of the outward flange portions located in longitudinal end portions can be distributed to the top sheet portion side and the vertical wall portion sides.

(2) The strain distribution in the outward flange portions can be controlled by changing the shape of a punch (shape of a lower die) forming the outward flange portions.

The present invention has been accomplished based on such findings.

To solve the problems, one aspect of the present invention is a method for manufacturing a press formed article including: when a press formed article is manufactured from a metal sheet, the press formed article including a top sheet portion, a vertical wall portion continuous to end portions in the width direction of the top sheet portion via a protruding ridge portion, and an outward flange portion continuous to longitudinal end portions of the top sheet portion, longitudinal end portions of the protruding ridge portion, and longitudinal end portions of the vertical wall portion via a recessed ridge portion, bending the metal sheet at the position of the protruding ridge portion and forming the metal sheet into an L-shape in cross section, and then bending the metal sheet at the position of the recessed ridge portion and forming the outward flange portion in a state where an area to be the outward flange portion is released.

Another aspect of the present invention is a method for manufacturing a press formed article including: when a press formed article is manufactured from a metal sheet, the press formed article including a top sheet portion, a vertical wall portion continuous to end portions in the width direction of the top sheet portion via a protruding ridge portion, and an outward flange portion continuous to longitudinal end portions of the top sheet portion, longitudinal end portions of the protruding ridge portion, and longitudinal end portions of the vertical wall portion via a recessed ridge portion, bending the metal sheet at the position of the protruding ridge portion and forming the metal sheet into an L-shape in cross section and bending the metal sheet at the position of the recessed ridge portion and forming the outward flange portion; in bending the metal sheet at the position of the recessed ridge portion and forming the outward flange portion, starting the application of a bending force to an area continuous to the longitudinal end portions of the top sheet portion and an area continuous to the longitudinal end portions of the vertical wall portion via the recessed ridge portion of an area to be the outward flange portion, and then applying the bending force to an area continuous to the longitudinal end portions of the protruding ridge portion via the recessed ridge portion; and, after the completion of the forming of the L-shape in cross section, completing the forming of the area continuous to the longitudinal end portions of the protruding ridge portion via the recessed ridge portion in the outward flange portion.

Another aspect of the present invention is a press forming device for manufacturing, from a metal sheet, a press formed article including a top sheet portion, a vertical wall portion continuous to end portions in the width direction of the top sheet portion via a protruding ridge portion, and an outward flange portion continuous to longitudinal end portions of the top sheet portion, longitudinal end portions of the protruding ridge portion, and longitudinal end portions of the vertical wall portions via recessed ridge portions, and the press forming device includes: a first upper die and a first lower die having forming surfaces capable of forming areas to be the top sheet portion and the vertical wall portion at the position where the protruding ridge portion is formed and forming the top sheet portion and the vertical wall portion continuous to the top sheet portion; and a second lower die bending the metal sheet at the recessed ridge portion and forming the outward flange portion, in which a forming surface in a part where a bending force is applied to an area to be the outward flange portion and the outward flange portion is formed in the second lower die includes, as viewed from the longitudinal direction of the top sheet portion, a top portion and a pair of slant surfaces continuous to both the right and left sides of the top portion and have a mountain-like shape protruding in the bending direction of the outward flange portions as a whole, and a top portion of the mountain-like shape is set to be able to abut on an area continuous to the longitudinal end portions of the top sheet portion via the recessed ridge portion of the area to be the outward flange portion.

Advantageous Effects of Invention

The aspects of the present invention enable the forming of the saddle-shaped press formed article having the top sheet portion, the vertical wall portions, and the outward flange portions formed across the longitudinal end portions of the top sheet portion and the vertical wall portions by a die of a simpler configuration.

For example, the aspects of the present invention can distribute the strain of the outward flange portions in the press formed article including the top sheet portion, the vertical wall portions formed on both sides of the top sheet portion, and the outward flange portions (flange portions in the longitudinal end portions) continuously formed across the top sheet portion and the vertical wall portions without a die of a complicated configuration. As a result, it is possible to form a saddle-shaped press formed article of a shape having an increased flange width of the ridge portions with a simple die structure.

BRIEF DESCRIPTION OF DRAWINGS

FIGS. 9A to 9C are views illustrating an example of the contour shape of slant surfaces of a mountain-like shape in the second lower die, in which FIG. 9A illustrates a case where the contour shape is a linear shape, FIG. 9B illustrates a case where the contour shape is a curved shape in which the slant surfaces have an upward-protruding bent shape, and FIG. 9C illustrates a case where the contour shape is a curved shape in which the slant surfaces have a downward-protruding bent shape;

DESCRIPTION OF EMBODIMENTS

Figure 1:
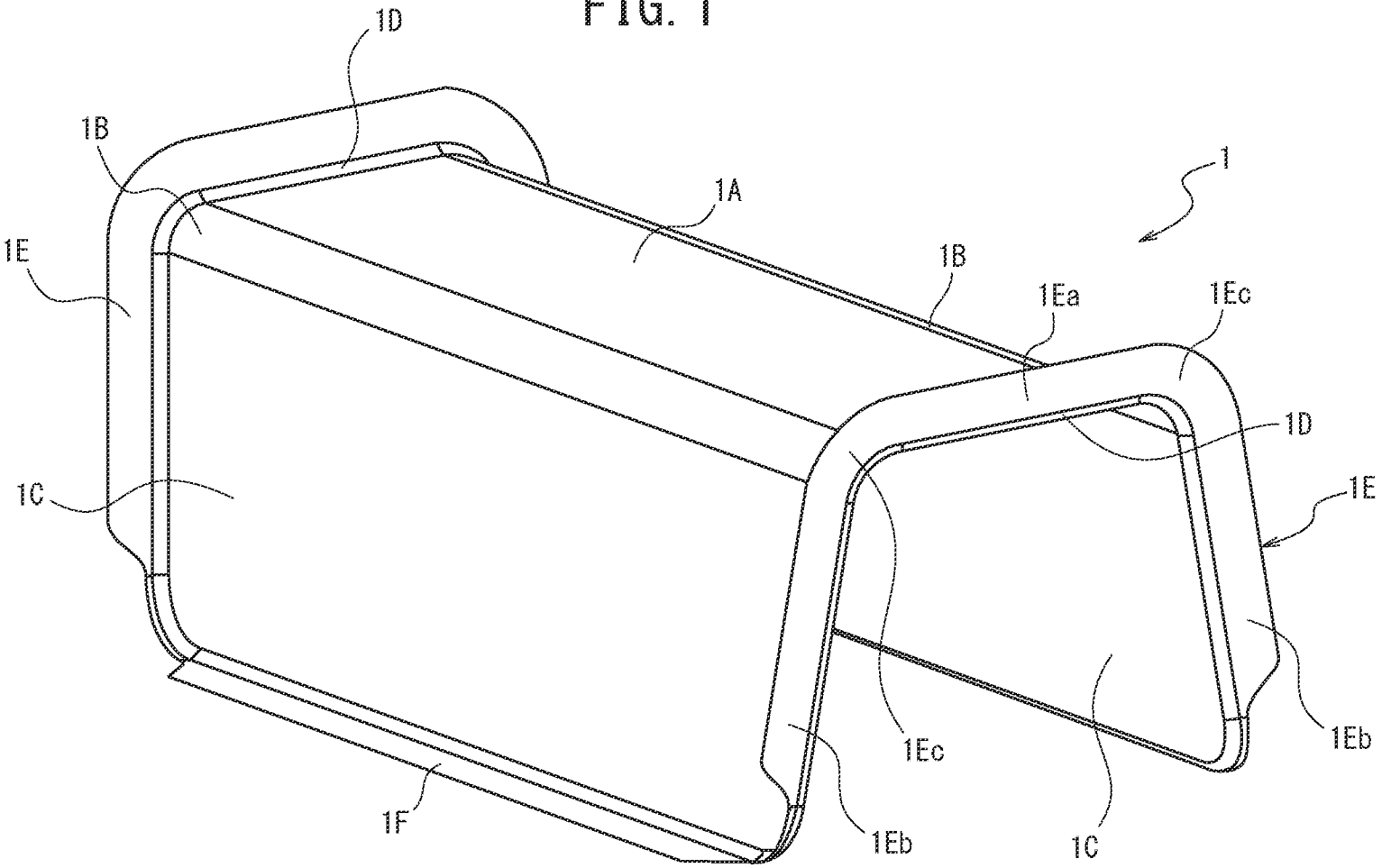
FIG. 1 is a perspective view illustrating an example of a press formed article according to embodiments based on the present invention.

Embodiments of the present invention are described with reference to the drawings.

Herein, the drawings are schematic and the relationship between the thickness and the plane dimension of each component, the ratio of each component, and the like are different from the actual relationship, ratio, and the like. The embodiments described below exemplify configurations for embodying the technical idea of the present disclosure. The technical idea of the present disclosure does not specify shapes, structures, and the like of constituent components to the shapes, structures, and the like described below. The technical idea of the present disclosure can be variously altered within the technical range defined by Claims. The same reference numerals are attached to the same configurations.

[Press Formed Article 1]

Each embodiment described later describes a case where a saddle-shaped press formed article 1 illustrated in FIG. 1 is manufactured as an example.

The press formed article 1 illustrated in FIG. 1 includes a top sheet portion 1A, right and left vertical wall portions 1C continuous to both sides in the width direction of the top sheet portion 1A via right and left protruding ridge portions 1B, respectively, and outward flange portions 1E. The outward flange portions 1E are continuous to longitudinal end portions of the top sheet portion 1A, longitudinal end portions of the protruding ridge portions 1B, and longitudinal end portions of the right and left vertical wall portions 1C via recessed ridge portions 1D.

The press formed article 1 illustrated in FIG. 1 has lower flange portions 1F continuous to lower end portions of the vertical wall portions 1C. The saddle-shaped press formed article may not have the lower flange portions 1F.

The shape illustrated in FIG. 1 has the vertical wall portion 1C on each of both sides in the width direction of the top sheet portion 1A, and thus has a U-shape in cross section. However, the shape of the press formed article 1 may be a pressed component shape having the vertical wall portion 1C only on one side in the width direction of the top sheet portion 1A, and thus may have an L-shape in cross section. Even in the case of such a press formed article 1, the present invention is applicable. Herein, the U-shape in cross section and the L-shape in cross section also include a cross-sectional shape having a flange portion/flange portions in a lower end portion/lower end portions of the vertical wall portion 1C/the vertical wall portions 1C, respectively.

FIG. 1 illustrates a case where the outward flange portion 1E is formed in each of both longitudinal end portions. The saddle-shaped press formed article 1 may have the outward flange portion 1E only in one longitudinal end portion.

Figure 2:
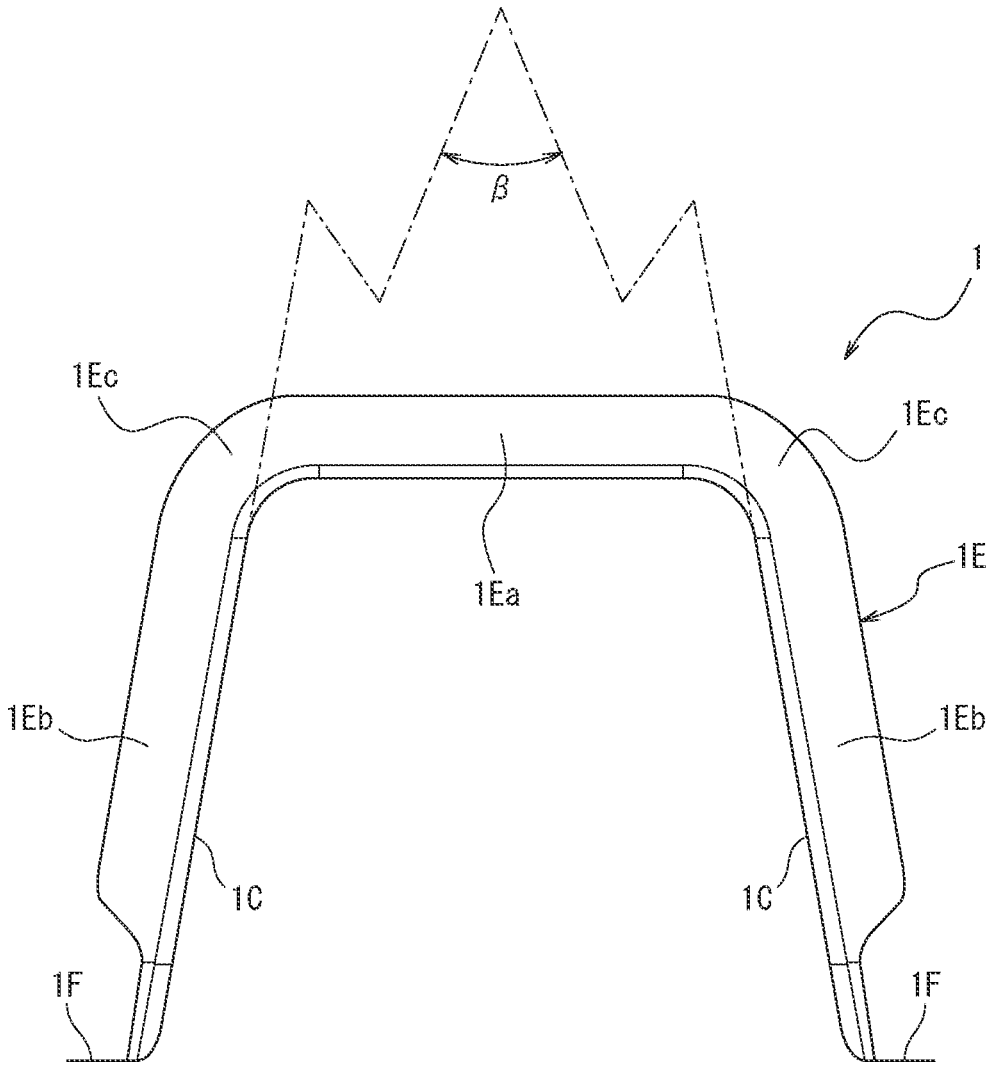
FIG. 2 is a front view of the press formed article in FIG. 1 as viewed from the longitudinal direction of a top sheet portion.

The outward flange portions 1E are formed as one flange portion continuous to the longitudinal end portions of the top sheet portion 1A, the longitudinal end portions of the protruding ridge portions 1B, and the longitudinal end portions of the right and left vertical wall portion 1C and across the top sheet portion 1A along the width direction. More specifically, the outward flange portion 1E includes, as illustrated in FIG. 2, a top sheet portion side area 1Ea (area contiguous to the longitudinal end portions of the top sheet portion 1A), right and left vertical wall portion side areas 1Eb (areas continuous to the longitudinal end portions of the vertical wall portions 1C), and right and left ridge portion side areas 1Ec (areas continuous to longitudinal end portions of the protruding ridge portion 1B) connecting the top sheet portion side area 1Ea and the vertical wall portion side areas 1Eb.

In the following description, an area to be the top sheet portion side area 1Ea is sometimes described as a top sheet portion side constituting portion, areas to be the vertical wall portion side areas 1Eb are sometimes described as vertical wall portion side constituting portions, and areas to be the ridge portion side areas 1Ec are sometimes described as corner constituting portions, of areas to be the outward flange portions 1E in a metal sheet (blank). The same reference numeral is attached to the top sheet portion side area 1Ea and the top sheet portion side constituting portion for description. The same reference numeral is attached to the vertical wall portion side areas 1Eb and the vertical wall portion side constituting portions for description. The same reference numeral is attached to the ridge portion side areas 1Ec and the corner constituting portions for description.

First Embodiment

A first embodiment based on the present invention is described with reference to the drawings.

(Method for Manufacturing Press Forming Article)

First, a method for manufacturing a press forming article of this embodiment is described.

The method for manufacturing a press forming article of this embodiment includes a first step and a second step.

<First Step>

The first step is a step of forming the metal sheet (blank) at the positions of the right and left protruding ridge portions 1B to form the metal sheet into the U-shape in cross section. In the first step, when focusing on one vertical wall portion 1C in the width direction of the top sheet portion 1A, the first step is the same as a step of bending the metal sheet at the position of the protruding ridge portion 1B and forming the metal sheet into an L-shape in cross section.

As a press method, this embodiment exemplifies a form construction method for simply sandwiching the metal sheet by an upper die and a lower die. The pressing method may be pad forming using a pad or drawing using a blank holder.

In the first step, it is preferable that an area to be the top sheet portion 1A and areas to be the vertical wall portions 1C are press formed in a state where the areas to be the outward flange portions 1E are released, and the metal sheet is formed into the U-shape in cross section (L-shape in cross section). The "released state" refers to a state where the areas to be the outward flange portions 1E are not restrained. More specifically, the forming in the first step is carried out in a state where the areas to be the outward flange portions 1E are in a free state. This makes it easier to carry out the second step in succession to the first step.

<Second Step>

The second step is a step of bending the metal sheet formed into the U-shape in cross section in the first step at the positions of the recessed ridge portions 1D and forming the outward flange portions 1E.

In the second step, the metal sheet is bent at the positions of the recessed ridge portions 1D, and the outward flange portions 1E are formed. At that time, the setting is preferably performed such that, after starting the application of a bending force to the top sheet portion side constituting portion 1Ea and the vertical wall portion side constituting portions 1Eb among the areas to be the outward flange portions 1E, the bending force is applied to the corner constituting portions 1Ec. The top sheet portion side constituting portion 1Ea is a part continuous to the longitudinal end portions of the top sheet portion 1A via the recessed ridge portions 1D. The vertical wall portion side constituting portions 1Eb are parts continuous to the longitudinal end portions of the vertical wall portions 1C via the recessed ridge portions 1D. The corner constituting portions 1Ec are parts continuous to the longitudinal end portions of the protruding ridge portions 1B via the recessed ridge portions 1D.

For example, for the vertical wall portion side constituting portions 1Eb, the setting is performed such that the application of the bending force starts in order from lower positions away from the corner constituting portions 1Ec toward the corner constituting portions 1Ec. Then, the setting is performed such that, after the application of the bending force is started to the vertical wall portion side constituting portions 1Eb, the application of the bending force is started to the top sheet portion side constituting portion 1Ea.

For example, the application of the bending force to the top sheet portion side constituting portion 1Ea is set as follows. More specifically, the setting is performed such that the application of the bending force starts from the side of a center portion in the width direction of the top sheet portion 1A in the top sheet portion side constituting portion 1Ea, and the application of the bending force is performed in order toward the corner constituting portion 1Ec sides. There is no problem when the starting position of the application of the bending force to the top sheet portion side constituting portion 1Ea is a middle position in the width direction of the top sheet portion 1A in the top sheet portion side constituting portion 1Ea. The starting position of the application of the bending force to the top sheet portion side constituting portion 1Ea is 0 mm or more and preferably 3 mm or more away from the ends of the corner constituting portions 1Ec. Herein, it was confirmed by an experiment that the sheet thickness reduction rate in the corner constituting portions 1Ec is more improved in a case of setting the starting position of the application of the bending force by a top portion 12A of a second lower die 12 at a position 0 mm or more and preferably 3 mm or more away from the ends of the corner constituting portions 1Ec and performing press forming than in a case of simultaneously applying the bending force to the top sheet portion side constituting portion 1Ea and the corner constituting portions 1Ec. In particular, by separating the position from the corner constituting portions 1Ec by 3 mm or more, the starting position of the application of the bending force by the top portion 12A of the second lower die 12 can be more reliably set inside the corner constituting portions 1Ec.

The ends of the corner constituting portions 1Ec refer to boundary portions between the corner constituting portions 1Ec of a circular arc shape, and the top sheet portion side constituting portions 1Ea and the vertical wall portion side constituting portions 1Eb.

It is preferable to carry out the processing of forming the outward flange portions 1E in a state where the metal sheet is restrained in the formed U-shape in cross section (L-shape in cross section). In this case, the first step and the second step can be successively carried out by one press working.

Herein, the angle of the L-shape in cross section after the first step and the angle of the L-shape in cross section of the target saddle-shaped press formed article 1 may be different from each other. However, both the angles are preferably equal to each other. By forming the outward flange portions 1E after the first step, the springback of the vertical wall portions 1C against the top sheet portion 1A is suppressed. As a result, a change in the shape at the time of die release can be suppressed to a low degree.

The first step and the second step may be carried out using separate dies.

After the second step, a step of restriking processing for improving the accuracy of the shape and the dimension may be provided.

Herein, the second step may be started during the first step.

(Press Forming Device)

An example of a press forming device for implementing the method for manufacturing a pressed component shape in this embodiment is described below.

This embodiment has a first upper die 11 and a first lower die and a second upper die and a second lower die 12 as a press forming die.

Figure 3:
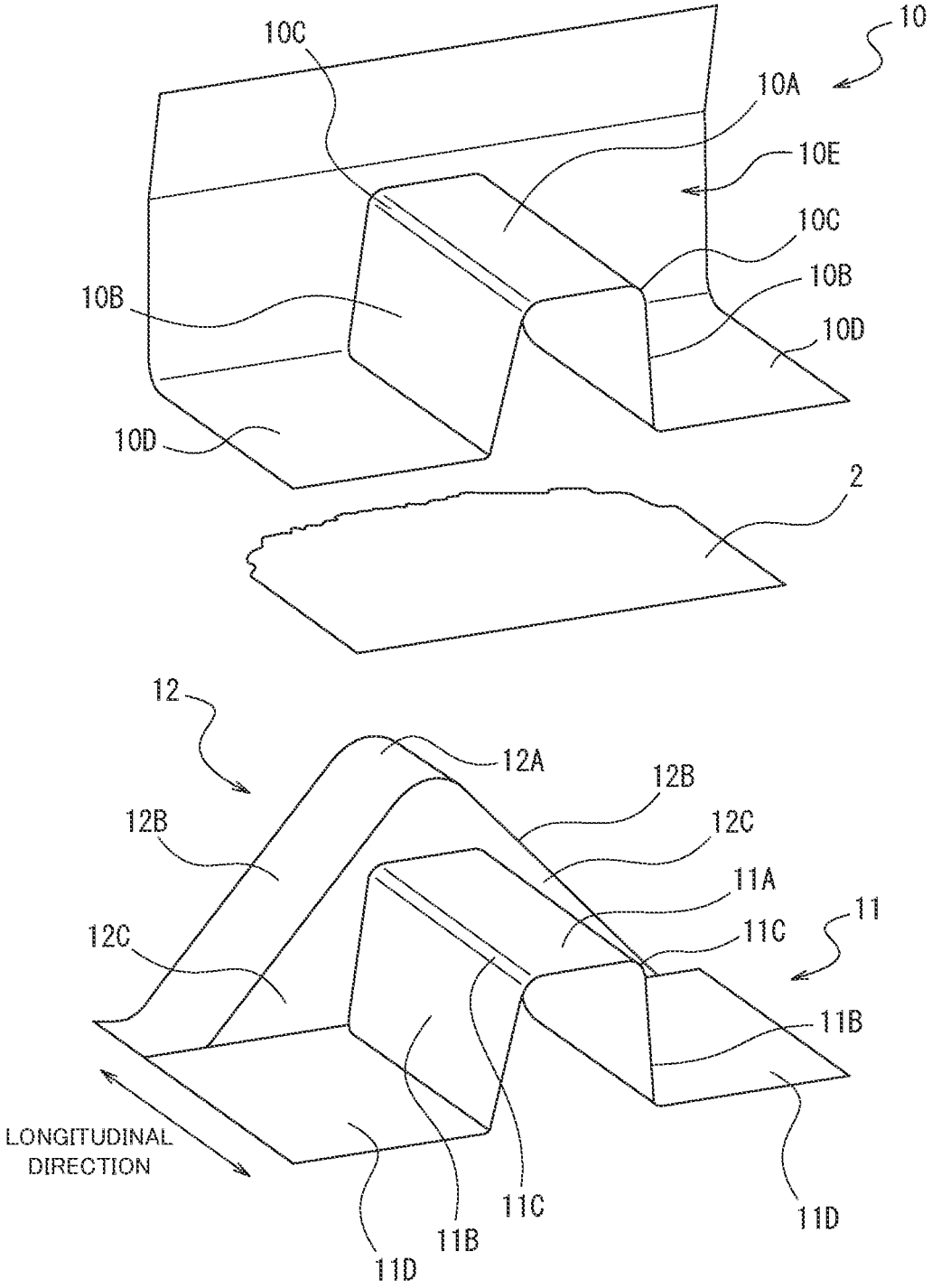
FIG. 3 illustrates schematic perspective views illustrating a configuration example of dies used in a press forming device according to the embodiments based on the present invention.

As illustrated in FIG. 3, this embodiment describes a case where the press forming device has the first upper die and the second upper die which are constituted by one upper die 10 (die) as an example. A first lower die 11 and a second lower die 12 are configured to be arranged in a state of being offset in the longitudinal direction of the top sheet portion 1A. According to this configuration, the press forming of the first step and the press forming of the second step can be carried out by one press working.

A die configuration may be acceptable in which the first upper die 10 and the first lower die 11, and the second upper die and the second lower die 12 are independent dies. A device configuration may be acceptable in which the first upper die 10 and the first lower die 11, and the second upper die and the second lower die 12 are individually set in a press machine for carrying out press working.

<First Upper Die 10 and First Lower Die 11>

The first upper die 10 and the first lower die 11 are dies for carrying out the first step.

The first upper die 10 and the first lower die 11 have forming surfaces capable of forming the areas to be the top sheet portion 1A and the vertical wall portions 1C in the metal sheet 2 at positions where the protruding ridge portions 1B are formed. The first upper die 10 and the first lower die 11 are dies for forming the metal sheet 2 into the U-shape in cross section.

The first lower die 11 constitutes a punch. The first lower die 11 has a forming surface shape of the U-shape in cross section as illustrated in FIG. 3 illustrating the forming surfaces of the dies and has a first top sheet surface 11A abutting on the lower surface of the area to be the top sheet portion 1A, punch shoulder portions 11C abutting on the lower surfaces of the areas to be the protruding ridge portions 1B, right and left first side surfaces 11B abutting on the lower (inner surface) surfaces of the areas forming the vertical wall portions 1C, and right and left first flange surfaces 11D abutting on the lower surfaces of the areas to be the lower flange portions of the metal sheet 2.

The first upper die 10 constitutes the die and faces the first lower die 11 in the vertical direction (press direction) The first upper die 10 has a forming surface shape of the U-shape in cross section as illustrated in FIG. 3. Specifically, the first upper die 10 has a second top sheet surface 10A abutting on the upper surface of the area to be the top sheet portion 1A, die shoulder portions 10C abutting on the upper surfaces of the areas to be the protruding ridge portions 1B, right and left second side surfaces 10B abutting on the upper surfaces (outer surfaces) of the areas forming the vertical wall portions 1C, and right and left second flange surfaces 10D abutting on the upper surfaces of the areas to be the lower flange portions of the metal sheet 2.

Figure 4:
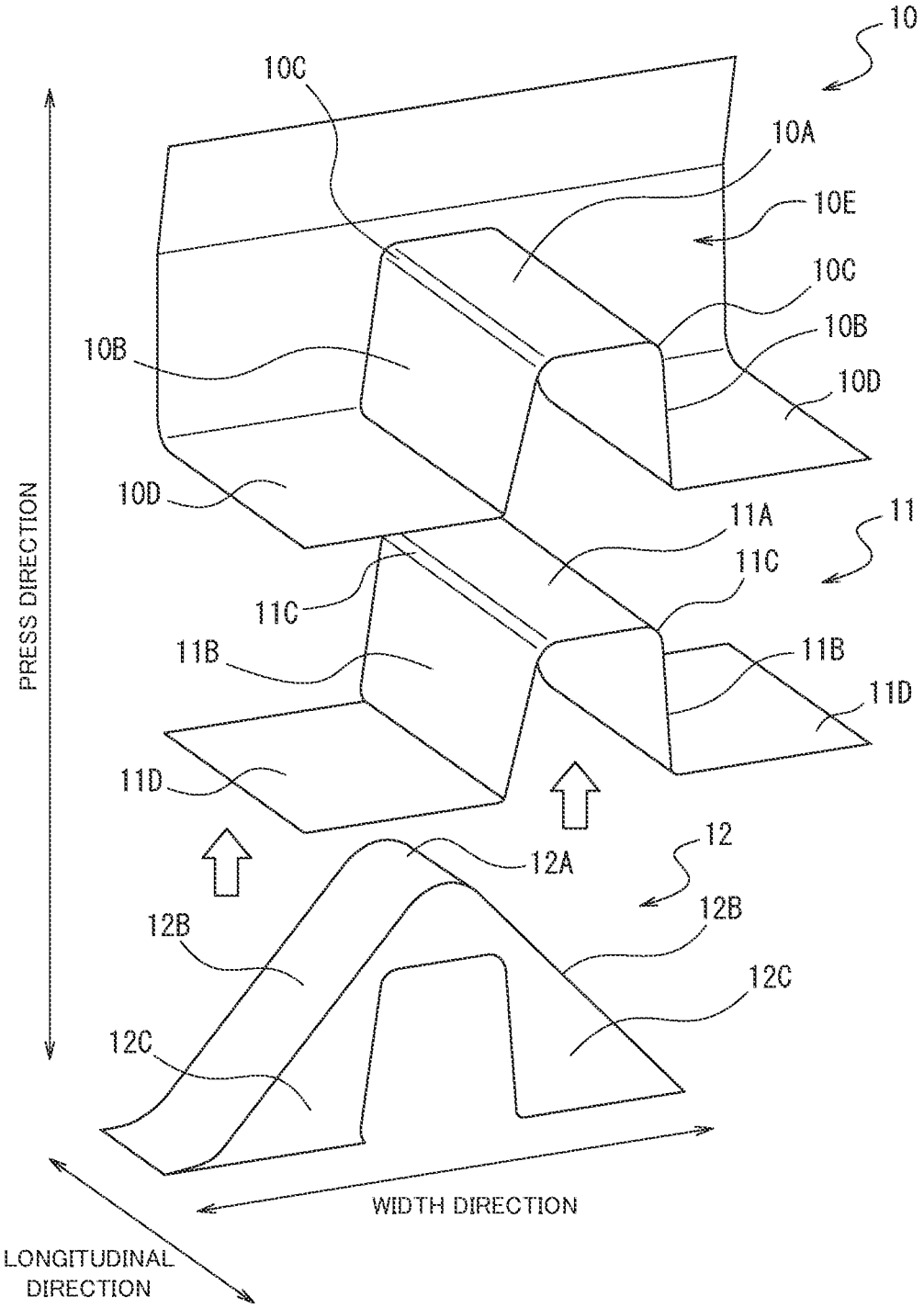
FIG. 4 illustrates views illustrating a state where a first lower die is moved upward.
Figure 6:
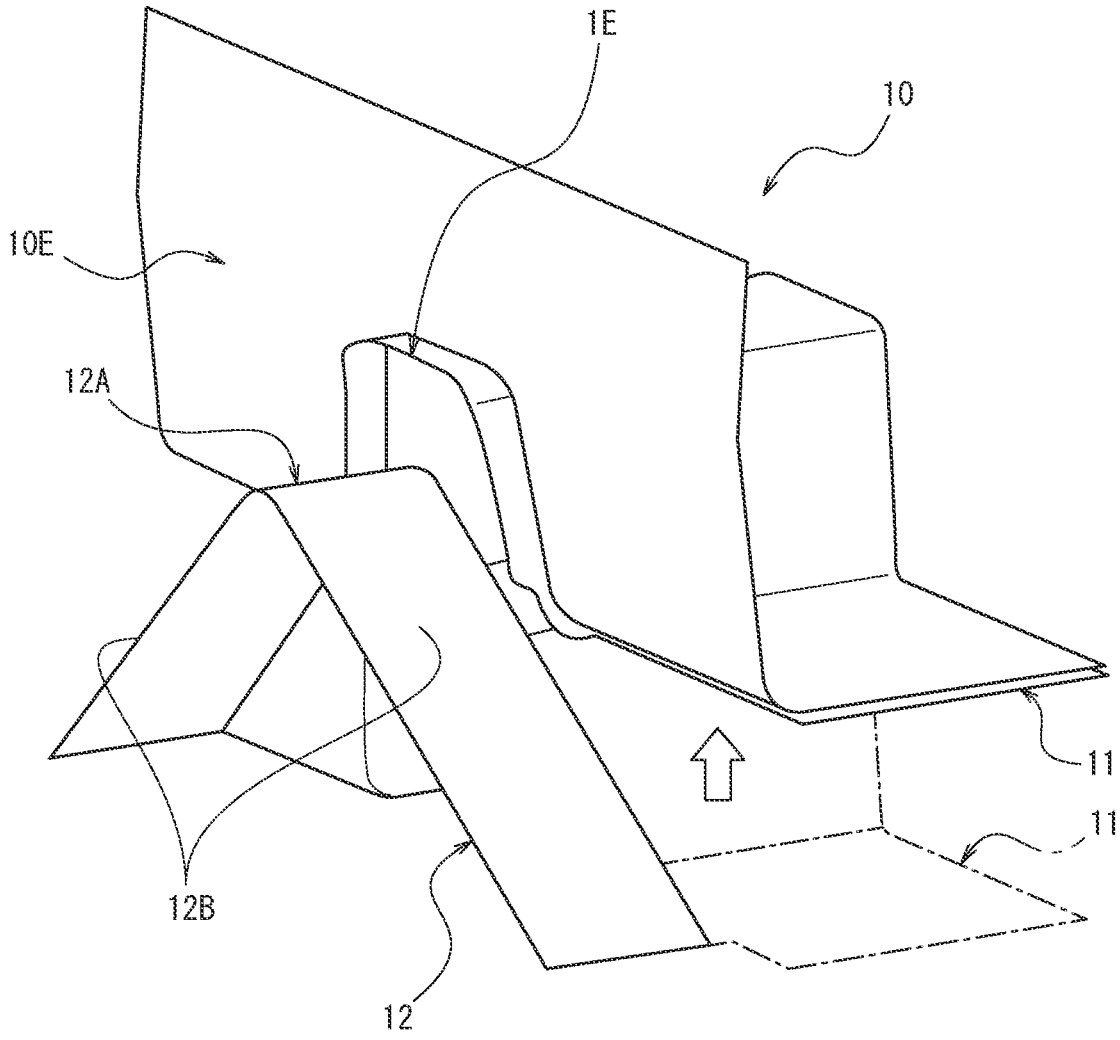
FIG. 6 is a schematic perspective view illustrating a state where press forming is performed by a first upper die and a first lower die.

The press forming device is configured such that the first lower die 11 relatively moves toward the first upper die 10 as in the movement from the position of FIG. 3 to the position of FIG. 4. Thus, the metal sheet 2 is sandwiched by the first lower die 11 and the first upper die 10 as illustrated in FIG. 6. As a result, the metal sheet 2 is bent at the protruding ridge portions 1B and formed into the shape of the U-shape in cross section.

At this time, in this embodiment, the forming surfaces of the first lower die 11 and the first upper die 10 do not abut on the area to be the outward flange portion 1E as illustrated in FIG. 6. However, the area to be the outward flange portion 1E is formed into the U-shape in cross section, as are the top sheet portion 1A and the vertical wall portion 1C.

<Second Upper Die and Second Lower Die 12>

The second upper die and the second lower die 12 are dies for carrying out the second step.

The second upper die and the second lower die 12 are dies for bending and forming, at the recessed ridge portions 1D, the metal sheet 2, which has been formed by the first upper die and the first lower die 11 to be formed into the U-shape in cross section (L-shape in cross-section), and forming the outward facing flange portions 1E.

In this embodiment, the first upper die and the second upper die are configured as one upper die 10 as described above.

The second upper die has a forming surface 10E capable of abutting on the upper surface side of the bent outward flange portion 1E as illustrated in FIGS. 3 and 6. The forming surface 10E is constituted by a rising surface rising upwards from each of the longitudinal end portions of the first upper die 10.

The second lower die 12 is arranged in a press machine in a state of being offset in the longitudinal direction of the top sheet portion 1A with respect to the first lower die 11 as illustrated in FIGS. 3 and 6.

The forming surface in a part where the bending force is applied to the area to be the outward flange portion and the outward flange portion is formed of the second lower die 12 in this embodiment includes the top portion 12A and slant surfaces 12B, which form one pair, continuous to both the right and left sides of the top portion 12A as illustrated in FIGS. 3 and 4 as viewed from the longitudinal direction of the top sheet portion 1A. Thus, the forming surface has a mountain-like shape protruding in the bending direction (press direction) of the outward flange portion 1E as a whole with the top portion 12A as the apex.

Figure 5:
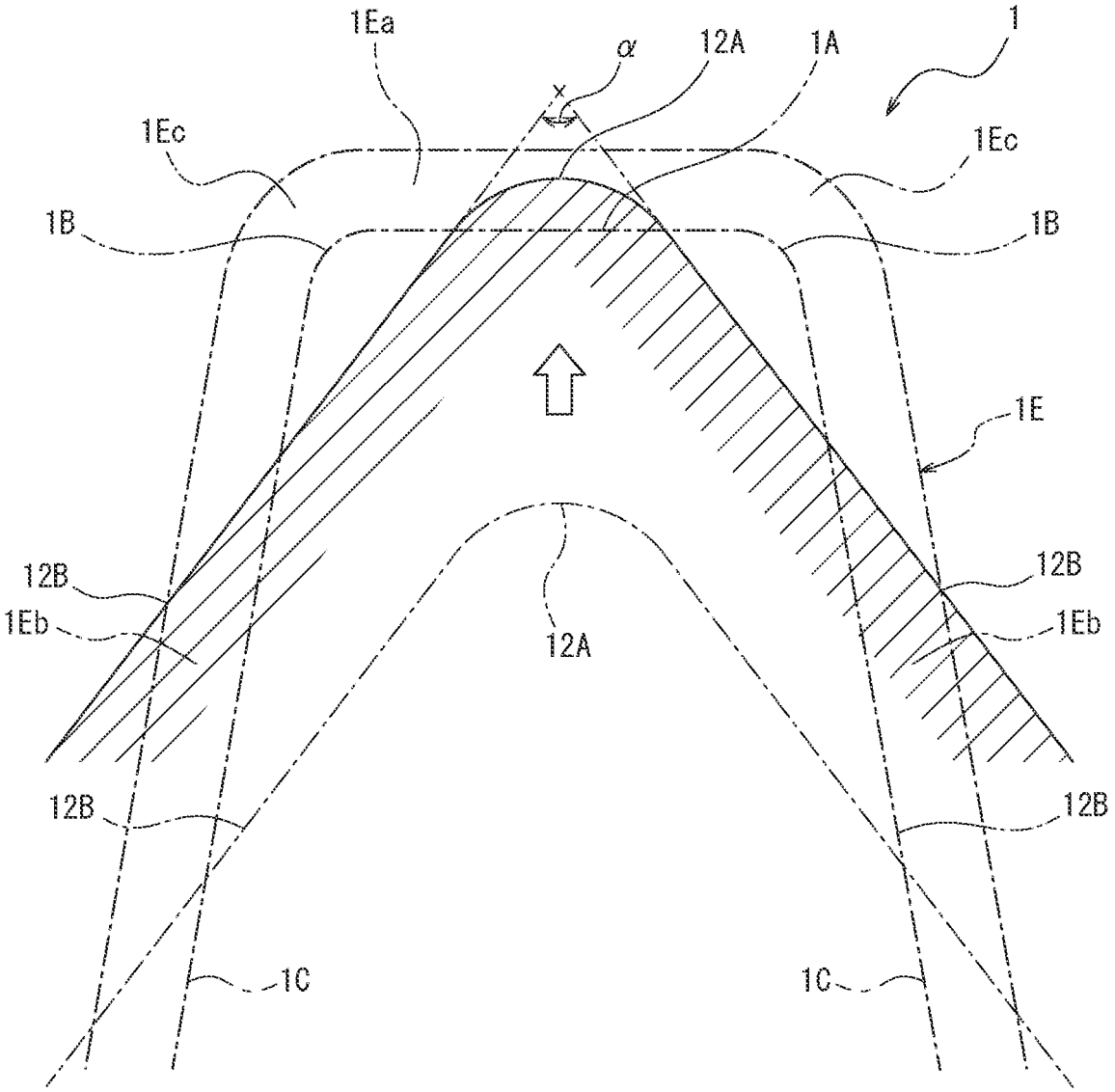
FIG. 5 is a view for explaining the action by a mountain-like shape of a second lower die.

The top portion 12A of the mountain-like shape is set to be able to first abut on the top sheet portion side constituting portion 1Ea (see FIGS. 5 and 6). Preferably, the top portion 12A of the mountain-like shape is set to abut on a position continuous to a center portion in the width direction of the top sheet portion 1A in the top sheet portion side constituting portion 1Ea.

In the mountain-like shape, the width of the top portion 12A (circular arc-shaped part in FIG. 5) is smaller than the width of the top sheet portion 1A (length of the top sheet portion side constituting portion 1Ea) as illustrated in FIG. 5.

As illustrated in FIG. 5, a punch angle $\alpha$ formed by the crossing angle of the extensions of the right and left slant surfaces 12B forming the mountain-like shape is wider than twice an angle obtained by subtracting 90° from an angle formed by the top sheet portion 1A and the vertical wall portion 1C in the metal sheet 2 of the L-shape in cross section. The angle twice the angle obtained by subtracting 90° from the angle formed by the top sheet portion 1A and the vertical wall portion 1C is equal to a crossing angle $\beta$ (see FIG. 2) formed by the right and left vertical wall portions 1C. The crossing angle $\beta$ is the angle on the top sheet portion 1A side. More specifically, the punch angle $\alpha$ is set wider than the crossing angle $\beta$ (see FIG. 2) formed by the extensions of the right and left vertical wall portions 1C as illustrated in FIG. 5. More specifically, the setting is performed such that the slope of the slant surface 12B is larger than the slope of the vertical wall portion 1C to be formed (abut).

The punch angle $\alpha$ is in the range of 60° or more and 180° or less and preferably in the range of 80° or more and 140° or less, for example. Herein, the crossing angle $\beta$ is less than 40°, for example. The angle formed by the top sheet portion 1A and the vertical wall portion 1C is the angle on the inner surface side.

When the setting is performed as described above, the right and left slant surfaces 12B in the second lower die 12 first start to abut on the vertical wall portion side constituting portions 1Eb in order from the lower end portion sides toward the upper end portion sides (corresponding to the corner constituting portions 1Ec), and then can start the application of the bending force in order as illustrated in FIG. 5. More specifically, the setting can be performed such that the right and left slant surfaces 12B form the vertical wall portion side constituting portions 1Eb from the lower side to the upper side.

As illustrated in FIG. 5, the slant surfaces 12B of the mountain-like shape start the application of the bending force to the vertical wall portion side constituting portions 1Eb. Thereafter, the application of the bending force is started to the top sheet portion side constituting portion 1Ea by the top portion 12A of the mountain-like shape. Specifically, the application of the bending force is first started by the top portion 12A to a part continuous to the center portion in the width direction of the top sheet portion 1A in the top sheet portion side constituting portion 1Ea. Subsequently, the application of the bending force is started in order toward the corner constituting portion 1Ec sides. More specifically, the forming is started from the center portion side toward the end portion sides of the top sheet portion side constituting portion 1Ea, so that the forming is performed.

When the length (height) of the vertical wall portion side constituting portion 1Eb is short, the forming is sometimes first started from the top sheet portion side constituting portion 1Ea After the forming in the vertical wall portion side constituting portion 1Eb and the top sheet portion side constituting portion 1Ea has been started, the start of the application of the bending force to the corner constituting portions 1Ec is carried out, so that the outward flange portions 1E are formed.

With respect to the start of the application of the bending force to the corner constituting portions 1Ec, the start of the application from the vertical wall portion side constituting portions 1Eb and the start of the application from the top sheet portion side constituting portion 1Ea may be deviated from or simultaneous with each other. The setting is preferably performed such that both the starts of the application are simultaneously performed. When the setting is performed such that a strain is equally applied to the vertical wall portion side constituting portions 1Eb and the top sheet portion side constituting portion 1Ea, the start of the application from the vertical wall portion side constituting portions 1Eb and the start of the application from the top sheet portion side constituting portion 1Ea are simultaneously performed.

When the press formed article 1 is manufactured using the press forming device described above, the first upper die 10 and the first lower die 11 press form the areas to be the top sheet portion 1A and the vertical wall portions 1C in the metal sheet 2 into the U-shape in cross section, for example. Subsequently, the second upper die and the second lower die form the outward flange portions 1E to the metal sheet 2, which has been press formed into the U-shape in cross section.

At this time, the outward flange portions 1E are formed by the second upper die and the second lower die while the state where the metal sheet 2 is restrained in the U-shape in cross section (L-shape in cross section) by the first upper die 10 and the first lower die 11 is being held in this embodiment.

The start of the formation of the outward flange portions 1E may be carried out during the press forming into the U-shape in cross section.

(Operations and Others)

In this embodiment, as the first step, the metal sheet 2 is formed into the U-shape in cross section (L-shape in cross section) by sandwiching the areas to be the top sheet portion 1A and the vertical wall portions 1C in the metal sheet 2 by the first upper die 10 and the first lower die 11.

In the state after the forming, a state is formed in which the areas to be the outward flange portions 1E protrude in a cantilevered manner from the first upper die 10 and the first lower die 11 in the lateral direction (in the left side direction in FIG. 6) as illustrated in FIG. 6.

In this embodiment, the second step is carried out in the state where the metal sheet 2 is restrained by the first upper die 10 and the first lower die 11. More specifically, the positions of the top sheet portion 1A and the vertical wall portions 1C of the metal sheet 2 are restrained using the first lower die 11 as a lower pad in the second step.

In this state, the metal sheet 2 is sandwiched by the first upper die 10 and the first lower die 11, and therefore the metal sheet 2 is in a state where a material is difficult to move both in the width direction of the top sheet portion 1A and in the height direction of the vertical wall portions 1C. In this embodiment, the processing of the second step is carried out in this state and the processing of forming the outward flange portions 1E is carried out.

The start of the second step raises the second lower die 12 of a protruding mountain-like shape (approaches the second upper die). Thus, the slant surfaces 12B of the second lower die 12 abut on the vertical wall portion side constituting portions 1Eb in order from the lower end portion sides toward above. Therefore, the metal sheet 2 is sandwiched with surfaces 12C of the second lower die 12 and a surface 10E of the second upper die 10 while the bending force is being applied from the lower side to the upper side to the areas to be the outward flange portions 1E continuous to the vertical wall portions 1C. As a result, the vertical wall portion side areas 1Eb of the outward flange portions 1E are formed by being bent and formed in order from the lower side toward above at the positions of the recessed ridge portions 1D (see FIG. 5).

At this time, the vertical wall portion side areas 1Eb are formed in order from the lower side (lower end portion) to the upper side, but the forming amount thereof is small. Further, the recessed ridge portions 1D at the positions extend in a linear state or in a substantially linear state along the movement direction of the second lower die 12. Therefore, a strain to be applied to the vertical wall portion side areas 1Eb due to this forming can also be reduced.

During the forming of the vertical wall portion side areas 1Eb, the top portion 12A of the mountain-like shape of the second lower die 12 hits a part continuous to the center portion in the width direction of the top sheet portion 1A in the top sheet portion side constituting portion 1Ea as illustrated in FIG. 5. This starts the application of the bending force to the top sheet portion side constituting portion 1Ea. A configuration may be acceptable in which the application of the bending force is started to the top sheet portion side constituting portion 1Ea side before the vertical wall portion side area 1Eb sides.

At this time, the top sheet portion side constituting portion 1Ea is lifted upward centering on the part continuous to the center portion in the width direction of the top sheet portion 1A in the top sheet portion side constituting portion 1Ea. As a result, a strain is applied to the part continuous to the center portion in the width direction of the top sheet portion 1A in the top sheet portion side constituting portion 1Ea.

When the forming of the vertical wall portion side areas 1Eb from the lower side approaches the corner constituting portions 1Ec, a state is formed in which one having stiffness is forcibly bent and raised in a relative manner. This causes a strain due to rubbing with a shoulder ridge portion (corner portion extending along the mountain-like shape) of the second lower die 12.

Further, as the second lower die 12 rises, the vertical wall portion side areas 1Eb and the top sheet portion side area 1Ea are being formed while the forming proceeds toward the corner constituting portions 1Ec, and the strain is applied to the vertical wall portion side areas 1Eb and the top sheet portion side area 1Ea in a balanced manner.

Subsequently, the second lower die 12 rises, and, immediately before the corner constituting portions 1Ec are completely bent and raised, the bent ridges at the positions of the recessed ridge portions 1D approach straight lines. As a result, even when the corner constituting portions 1Ec are bent and raised, the sheet thickness reduction rate at the corner constituting portions 1Ec can be reduced to a low degree.

In this embodiment, the outward flange portions 1E are formed by the mechanism described above.

As a result, the strain to be applied to the outward flange portions 1E is distributed in this embodiment. In particular, the strain in the ridge portion side areas 1Ec can be distributed to the vertical wall portion side areas 1Eb and the top sheet portion side area 1Ea. Therefore, the concentration of the strain on the ridge portion side areas 1Ec is suppressed and the sheet thickness reduction rate in the ridge portion side areas 1Ec is improved. As a result, the press formed article 1 illustrated in FIGS. 1 and 2 can be manufactured which has an increased flange width in the ridge portion side areas 1Ec (corner portions) in the outward flange portions 1E.

As described above, the saddle-shaped press formed article having the top sheet portion, the vertical wall portions, and the outward flange portions formed across the longitudinal end portions of the top sheet portion and the vertical wall portions can be formed by a die of a simpler configuration.

Second Embodiment

Next, a second embodiment based on the present invention is described with reference to the drawings.

The same reference numerals are attached to the same configurations and the like as those of the first embodiment for description.

[Method for Manufacturing Pressed Component Shape]

A method for manufacturing a pressed component shape of this embodiment is described.

The method for manufacturing a pressed component shape includes first forming processing and second forming processing described below as press forming processing.

This embodiment is different from the first embodiment in that the second forming processing is also performed while the first forming processing is performed. More specifically, the first forming processing and the second forming processing are performed synchronously with each other. However, it does not matter which of the first forming processing and the second forming processing is started first, but this embodiment is configured such that the first forming processing is completed first.

<First Forming Processing>

The first forming processing is processing of forming a metal sheet (blank) at positions of right and left protruding ridge portions 1B to form the metal sheet into a U-shape in cross section. In the first forming processing, when focusing on one vertical wall portion 1C in the width direction of a top sheet portion 1A, the first step is the same as the processing of bending the metal sheet at the position of the protruding ridge portion 1B and forming the metal sheet into the L-shape in cross section.

As a press method, this embodiment (manufacturing method described below) exemplifies a form construction method for simply sandwiching the metal sheet by an upper die and a lower die. Pad forming using a pad or drawing using a blank holder may be acceptable.

In the first forming processing, the area to be the top sheet portion 1A and areas to be the vertical wall portions 1C are press formed in a state where areas to be outward flange portions 1E are released, and the metal sheet is formed into the U-shape in cross section (L-shape in cross section). More specifically, the forming in the first forming processing is carried out in a state where the areas to be the outward flange portions 1E are in a free state, which makes it easier to carry out the second forming processing simultaneously with the first forming processing.

The first forming processing is equivalent to the first step in the first embodiment.

<Second Forming Processing>

The second forming processing is processing of bending the metal sheet formed into the U-shape in cross section by the first forming processing at the positions of recessed ridge portions 1D and forming the outward flange portions 1E.

The second forming processing of this embodiment is carried out in synchronous with the first forming processing. The second forming processing carries out processing of forming the areas to be the outward flange portions 1E, which are not pressed by the first forming processing, i.e., in a free state, into the outward flange portions 1E. The second forming processing may be started before the start of the first forming processing as described above, but the second forming processing is completed later.

The second forming processing is the same as the second step in the first embodiment, except that the second forming processing is carried out while the first forming processing is being performed.

In the second forming processing of this embodiment, the application of a bending force is started to a top sheet portion side constituting portion 1Ea and vertical wall portion side constituting portions 1Eb of the areas to be the outward flange portions 1E in the same manner as the second step of the first embodiment. Thereafter, the application of the bending force is started to corner constituting portions 1Ec continuous to longitudinal end portions of the protruding ridge portions 1B via the recessed ridge portions 1D. As a result, the outward flange portions 1E are formed in the second forming processing.

For example, the setting is performed such that, for the vertical wall portion side constituting portions 1Eb, the application of the bending force is started in order (sequentially) from lower positions away from the corner constituting portions 1Ec toward the corner constituting portions 1Ec. For example, the setting is performed such that, after the application of the bending force is started to the vertical wall portion side constituting portions 1Eb, the application of the bending force is started to the top sheet portion side constituting portion 1Ea.

For example, the application of the bending force to the top sheet portion side constituting portion 1Ea is set such that the application of the bending force is sequentially started from the side of a center portion in the width direction of the top sheet portion 1A in the top sheet portion side constituting portion 1Ea toward the corner constituting portion 1Ec sides. There is no problem when the starting position of the application of the bending force to the top sheet portion side constituting portion 1Ea is a middle position in the width direction of the top sheet portion 1A in the top sheet portion side constituting portion 1Ea. The starting position of the application of the bending force to the top sheet portion side constituting portion 1Ea is 0 mm or more and preferably 3 mm or more away from the boundaries between the corner constituting portions 1Ec and the top sheet portion side constituting portion 1Ea. Herein, it was confirmed by an experiment that the sheet thickness reduction rate in the corner constituting portions 1Ec is more improved in a case of separating the starting position of the application of the bending force by a top portion 12A of a second lower die 12 from the boundaries between the corner constituting portions 1Ec and the top sheet portion side constituting portion 1Ea by 0 mm or more and preferably 3 mm or more and performing press forming than in a case of simultaneously applying the bending force to the top sheet portion side constituting portion 1Ea and the corner constituting portions 1Ec. In particular, by separating the position from the corner constituting portions 1Ec by 3 mm or more, the starting position of the application of the bending force by the top portion 12A of the second lower die 12 can be more reliably set inside the corner constituting portions 1Ec.

In this embodiment, it is preferable that the processing of forming the outward flange portions 1E is completed in a state where at least a part of an area (for example, area to be the top sheet portion) to be the U-shape in cross section (L-shape in cross section) of a metal part is restrained. In this case, the first forming processing and the second forming processing can be carried out by one press working.

Herein, by forming the outward flange portions 1E together with the forming by the first forming processing, the springback of the vertical wall portions 1C against the top sheet portion 1A can be suppressed, and a change in the shape at the time of die release can be suppressed to a low degree.

The first forming processing and the second forming processing may be carried out using separate dies.

After the second forming processing, a step of restriking processing for improving the accuracy of the shape and the dimension may be provided.

(Press Forming Device)

An example of a press forming device for implementing the method for manufacturing a pressed component shape in this embodiment is described below.

This embodiment has a first upper die and the second lower die for performing the first forming processing and a second upper die and the second lower die for performing the second forming processing as a press forming die.

This embodiment describes a case where the first upper die and the second upper die are constituted by one upper die 10 (die) as an example as with the device of the first embodiment. A first lower die 11 and the second lower die 12 are configured to be arranged in a state of being offset in the longitudinal direction of the top sheet portion 1A. According to this configuration, the press forming for the first forming processing and the press forming for the second forming processing can be carried out by one press working.

A device configuration may be acceptable in which the first upper die 10 and the first lower die 11, and the second upper die and the second lower die 12 may be independent dies and the first upper die 10 and the first lower die 11, and the second upper die and the second lower die 12 are individually set in a press machine for carrying out press working as with the device of the first embodiment.

<First Upper Die 10 and First Lower Die 11>

The first upper die 10 and the first lower die 11 are dies for carrying out the first forming processing.

The device configuration of the first upper die 10 and the first lower die 11 is the same as that of the first embodiment, and therefore a description thereof is omitted (see FIG. 3).

<Second Upper Die and Second Lower Die 12>

The second upper die and the second lower die 12 are dies for carrying out the second forming processing.

The device configuration of the second upper die and the second lower die 12 is the same as that of the first embodiment, and therefore a description thereof is omitted (see FIG. 3).

<Forming Method Using Press Forming Device>

An example of a manufacturing method for manufacturing a press formed article 1 by performing the first forming processing and the second forming processing using the press forming device described above is described.

Herein, FIG. 3 illustrates a state before the start of forming. However, when focusing only on the lower die, the positional relationship between the first lower die 11 and the second lower die 12 in the vertical direction (stroke direction) illustrated in FIG. 3 is the positional relationship at the completion of the second forming processing and in the initial state.

More specifically, FIG. 3 illustrates a state where slant surfaces 12B of the second lower die 12 are displaced in the press direction (upward) relative to punch shoulder portions 11C of the first lower die 11 as viewed from the arrangement direction of the first lower die 11 and the second lower die 12. Specifically, a state is formed in which surfaces 12C of the second lower die 12 are partially exposed beyond the punch shoulder portions 11C, and the slant surfaces 12B can apply the bending force to the corner constituting portions 1Ec. In this state, a state is formed in which the bending force has also been applied to the corner constituting portions 1Ec.

Figure 7:
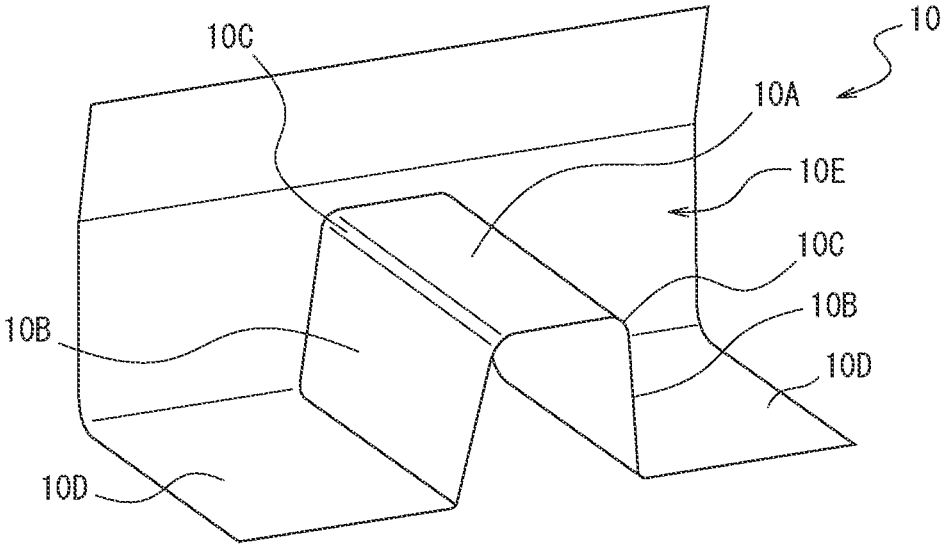
FIG. 7 illustrates views illustrating a state where the second lower die is stroked downward to perform a first step.
Figure 7:
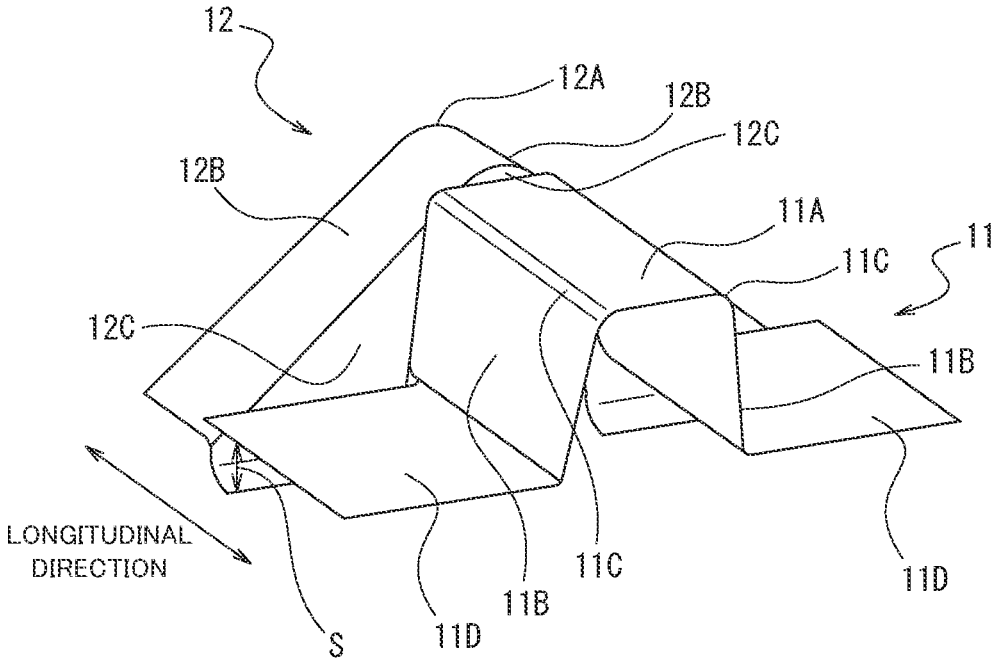

In contrast thereto, in this embodiment, the first lower die 11 is first stroked upward relatively to the second lower die 12 by a stroke amount S from the state of FIG. 3, so that a state of FIG. 7 is formed.

In the state of FIG. 7, the top portion 12A of the second lower die 12 protrudes in the press direction (upward in FIG. 7) from a first top sheet surface 11A of the first lower die 11. However, a state is formed in which the slant surfaces 12B of the second lower die 12 are displaced downward in the press direction relative to the punch shoulder portions 11C of the first lower die 11. Specifically, in the arrangement direction of the first lower die 11 and the second lower die 12, the surfaces 12C of the second lower die 12 are not exposed beyond (back side) the punch shoulder portions 11C.

Therefore, a state is formed in which the slant surfaces 12B cannot start the application of the bending force to the corner constituting portions 1Ec. More specifically, a state is formed in which the surfaces 12C of the second lower die 12 are not visible above the punch shoulder portions 11C of the first lower die 11, i.e., a state is formed in which the slant surfaces 12B are located on the lower side or at the same height at the positions of the punch shoulder portions 11C.

In FIG. 7, for the lower dies 11, 12, the upward direction is the press direction, and for the upper die 10, the downward direction is the press direction.

First Step in Second Embodiment

A first step in the second embodiment is described.

First, the first lower die 11 is stroked upward, and the first lower die 11 and the second lower die 12 are set in the state of FIG. 7.

Next, the upper die 10 is relatively pressed toward the lower dies 11, 12, and the first forming processing and part of the second forming processing are performed.

Figure 8:
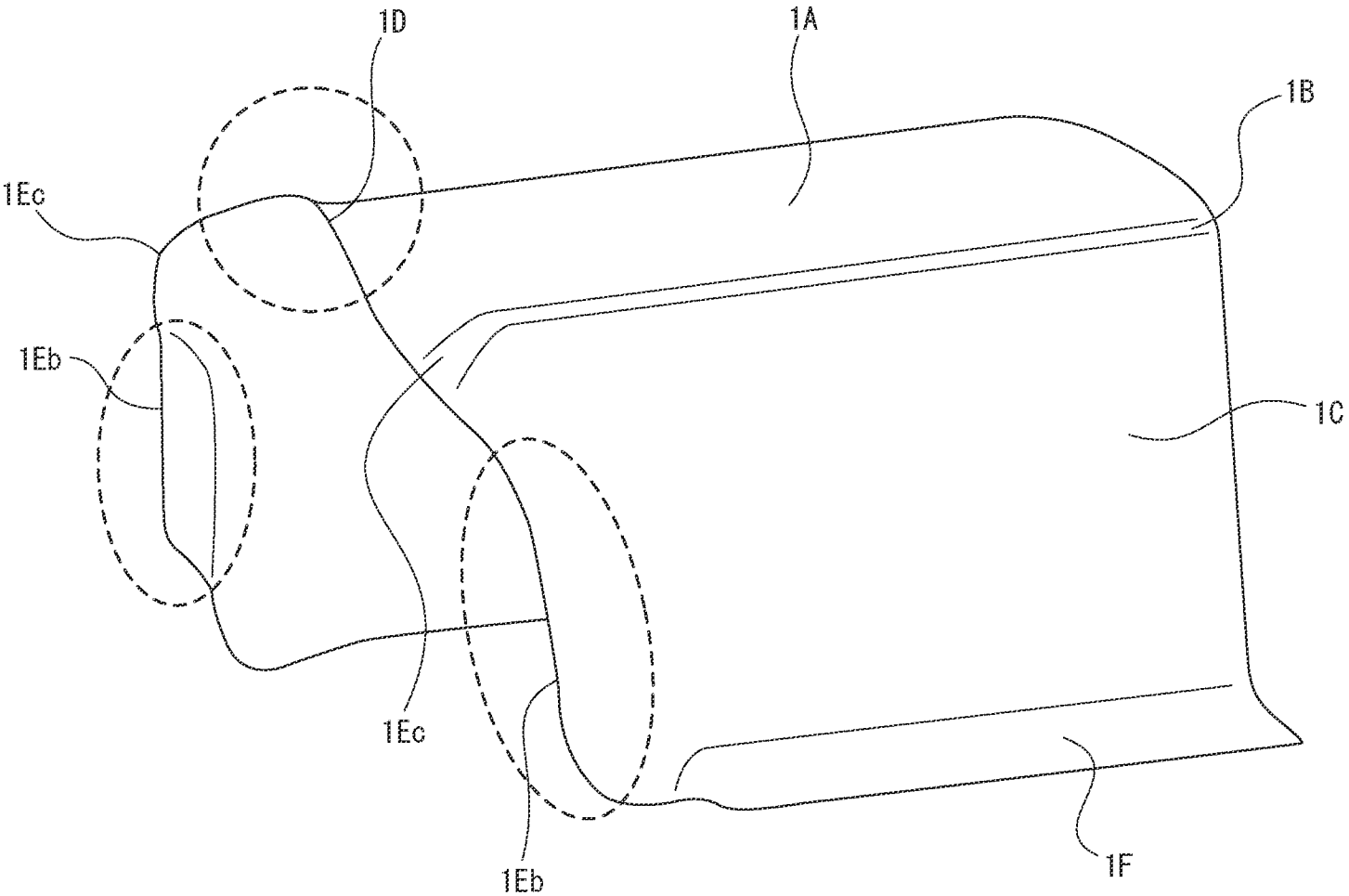
FIG. 8 is a schematic perspective view illustrating the shape of a formed article after first forming processing and second forming processing are partially performed by the first step.

In the state where the first step is completed, the blank is formed into a shape as illustrated in FIG. 8. In the shape illustrated in FIG. 8, the blank is bent at the positions of the protruding ridge portions 1B and formed into the U-shape in cross section (L-shape in cross section), and, simultaneously therewith, the blank is bent at the positions of the recessed ridge portions 1D and the outward flange portions 1E are also partially formed.

However, in this first step, the application of the bending force has been started for at least a part of the vertical wall portion side constituting portions 1Eb and the top sheet portion side constituting portion 1Ea, but the application of the bending force to the corner constituting portions 1Ec is not started. Alternatively, a state is formed in which the application of the bending force to the corner constituting portions 1Ec has been partially started.

In this first step, as part of the second forming processing, the application of the bending force to the vertical wall portion side constituting portions 1Eb and the top sheet portion side constituting portion 1Ea is carried out in order toward the corner constituting portion 1Ec sides.

Even when the first step is completed, the application of the bending force to the vertical wall portion side constituting portions 1Eb and the top sheet portion side constituting portion 1Ea may not be completed.

Second Step in Second Embodiment

A second step in the second embodiment is described.

In the second step, the relative position (vertical position) of the first lower die 11 and the second lower die 12 is moved downward as illustrated in FIG. 3 from the state of FIG. 7 in a state where the metal sheet is restrained by the first lower die 11 and the first upper die 10.

Specifically, the first lower die 11, which has been stroked upward, is stroked downward together by the upper die 10.

Thus, the second step is carried out subsequent to the processing of the first step.

In the second step, when the application of the bending force to the vertical wall portion side constituting portions 1Eb and the top sheet portion side constituting portion 1Ea has not been completed in the first step, the remaining application of the bending force to the vertical wall portion side constituting portions 1Eb and the top sheet portion side constituting portion 1Ea is carried out in order toward the corner constituting portions 1Ec. In the second step, the start of the application of the bending force to the corner constituting portion 1Ec is also subsequently carried out, and the outward flange portions 1E are formed.

As described above, in this embodiment, the metal sheet is bent at the positions of the recessed ridge portions and the outward flange portions are partially formed while the metal sheet is bent at the positions of the protruding ridge portions and formed into the U-shape in cross section (L-shape in cross section) in the first step. Further, in the second step, the formation of the outward flange portions is continued and the outward flange portions are formed.

However, when the metal sheet is bent at the positions of the protruding ridge portions and formed into the U-shape in cross section (L-shape in cross section), it is preferable not to carry out the start of the application of the bending force to the corner constituting portions 1Ec.

When this processing is adopted, the pre-stroke amount of the first lower die 11 can be reduced. More specifically, when the first lower die 11 is slightly pre-stroked upward, and the upper die 10 is lowered for pressing, the first lower die 11 may be stroked for only returning the first lower die 11 to its initial position.

(Operations and Others)

In this embodiment, as the first forming processing, the areas to be the top sheet portion 1A and the vertical wall portions 1C in the metal sheet 2 are sandwiched by the first upper die 10 and the first lower die 11. Thus, the metal sheet 2 is formed into the U-shape in cross section (L-shape in cross section). Only by the first forming processing, a state is formed in which the areas to be the outward flange portions 1E protrude in a cantilevered manner from the first upper die 10 and the first lower die 11 in the lateral direction (in the left side direction in FIG. 6) as described in the first embodiment (see FIG. 6).

In contrast thereto, in this embodiment, part of the second forming processing is carried out together with the first forming processing in the first step. Thereafter, the second forming processing is continued, and the outward flange portions are formed as the second step.

In the second step, the metal sheet 2 is sandwiched by the first upper die 10 and the first lower die 11. Therefore, the metal sheet 2 is in a state where a material is difficult to move both in the width direction of the top sheet portion 1A and in the height direction of the vertical wall portions 1C. In this embodiment, the processing of the second forming processing is continued in this state and the formation of the outward flange portions 1E is completed.

Herein, the second forming processing is started, and the second lower die 12 of a protruding mountain-like shape is relatively raised (approaches the second upper die), so that the slant surfaces 12B of the second lower die 12 abut on the vertical wall portion side constituting portions 1Eb in order from the lower end portion sides toward above. Therefore, the metal sheet 2 is sandwiched with the surface 12C of the second lower die 12 and the surface 10E of the upper die 10 while the application of the bending force is started from the lower side to the upper side to the areas to be the outward flange portions 1E continuous to the vertical wall portions 1C. Thus, the vertical wall portion side areas 1Eb of the outward flange portions 1E are formed by being bent and formed in order from the lower side toward above at the positions of the recessed ridge portions 1D (see FIG. 5).

At this time, the vertical wall portion side areas 1Eb are formed in order from the lower side (lower end portions) to the upper side, but the forming amount thereof is small. Further, the recessed ridge portions 1D at the positions extend in a linear state or in a substantially linear state along the movement direction of the second lower die 12. Therefore, the strain to be applied to the vertical wall portion side areas 1Eb due to this forming can also be reduced.

During the forming of the vertical wall portion side areas 1Eb, the top portion 12A of the mountain-like shape of the second lower die 12 hits a part continuous to the center portion in the width direction of the top sheet portion 1A in the top sheet portion side constituting portion 1Ea as illustrated in FIG. 5. As a result, the application of the bending force is started to the top sheet portion side constituting portion 1Ea. A configuration may be acceptable in which the application of the bending force is started to the top sheet portion side constituting portion 1Ea side before the vertical wall portion side area 1Eb sides.

At this time, the top sheet portion side constituting portion 1Ea is lifted upward centering on the part continuous to the center portion in the width direction of the top sheet portion 1A in the top sheet portion side constituting portion 1Ea. As a result, a strain is applied to the part continuous to the center portion in the width direction of the top sheet portion 1A in the top sheet portion side constituting portion 1Ea.

When the forming of the vertical wall portion side areas 1Eb from the lower side approaches the corner constituting portions 1Ec, a state is formed in which one having stiffness is forcibly bent and raised in a relative manner. This causes a strain due to rubbing with a shoulder ridge portion (corner portion extending along the mountain-like shape) of the second lower die 12.

Further, as the second lower die 12 rises, the vertical wall portion side areas 1Eb and the top sheet portion side area 1Ea are being formed while the forming proceeds toward the corner constituting portions 1Ec. At this time, the strain is applied to the vertical wall portion side areas 1Eb and the top sheet portion side area 1Ea in a balanced manner.

Subsequently, the second lower die 12 rises, and, immediately before the corner constituting portions 1Ec are completely bent and raised, the bent ridges at the positions of the recessed ridge portions 1D approach straight lines. Therefore, even when the corner constituting portions 1Ec are bent and raised, the sheet thickness reduction rate at the corner constituting portions 1Ec can be reduced to a low degree.

In this embodiment, the metal sheet 2 is formed into the U-shape in cross section (L-shape in cross section) and the outward flange portions 1E are partially formed by the mechanism described above. By continuing the formation of the outward flange portions 1E even after the completion of the forming of the U-shape in cross section, the outward flange portions 1E are formed. For the outward flange portions 1E, corner portions are finally formed.

As a result, the strain to be applied to the outward flange portions 1E is distributed in this embodiment. In particular, the strain in the ridge portion side areas 1Ec can be distributed to the vertical wall portion side areas 1Eb and the top sheet portion side area 1Ea. Therefore, the concentration of the strain on the ridge portion side areas 1Ec is suppressed and the sheet thickness reduction rate in the ridge portion side areas 1Ec is improved. As a result, the press formed article 1 illustrated in FIGS. 1 and 2 can be manufactured which has an increased flange width in the ridge portion side areas 1Ec (corner portions) in the outward flange portions 1E.

As described above, the saddle-shaped press formed article having the top sheet portion, the vertical wall portions, and the outward flange portions formed across the longitudinal end portions of the top sheet portion and the vertical wall portions can be formed by a die of a simpler configuration.

Herein, in this embodiment, the second forming processing may be started before the first forming processing or the first forming processing and the second forming processing may be simultaneously started as described above.

The first forming processing is preferably started first.

(Modifications)

Herein, modifications of the first and second embodiments are described.

(Modification 1)

Figure 9A:
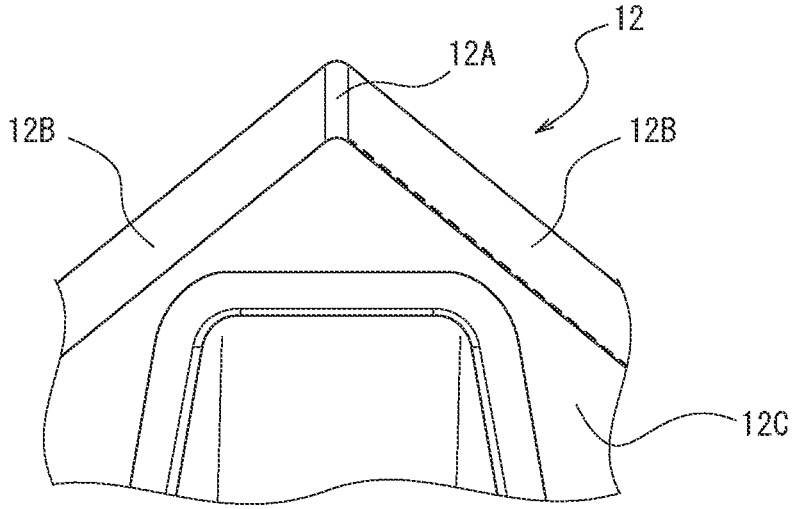

The contour shape of the slant surfaces 12B in the slant direction away from the top portion 12A of the slant surface 12B of the second lower die 12 may not be the linear shape (see FIG. 9A). The slant surfaces 12 may be in a slant shape toward a direction opposite to the press direction as away from top portion 12A.

Figure 9B:
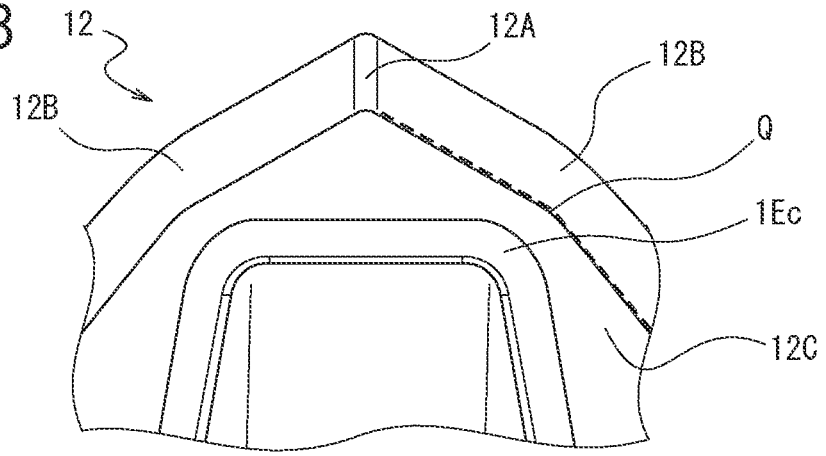
Figure 9C:
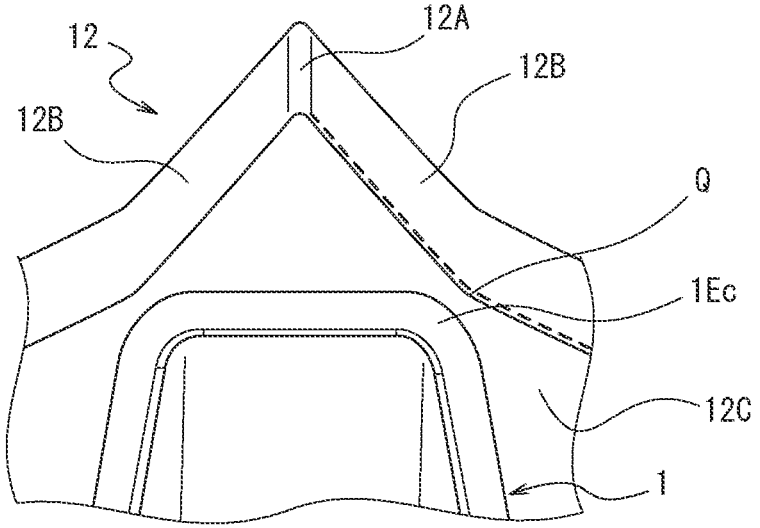

The other examples of the contour shape of the slant surfaces 12B are illustrated in FIGS. 9B and 9C. FIG. 9B illustrates an example in which the contour shape of the slant surfaces 12B is in a curved shape protruding in the press direction (upper side in FIG. 9). FIG. 9C illustrates an example in which the contour shape of the slant surfaces 12B is in a curved shape protruding in a direction opposite to the press direction.

Among FIGS. 9A to 9C, the curved shape in FIG. 9C is preferable. FIGS. 9B and 9C illustrate curved shapes in which the slant surface 12B is bent at a bending point Q, i.e., curved shapes in which two straight lines are connected at the position of the bending point Q. In this case, it is preferable to set the position of the bending point Q, which is the most vertically displaced with respect to the linear shape, to correspond to the punch shoulder portion 11C. More specifically, it is preferable to set the position of the bending point Q and the vicinity thereof in an application portion of the bending force to the corner constituting portion 1Ec.

The curved shape may be a circular arc shape.

(Modification 2)

Figure 10A:
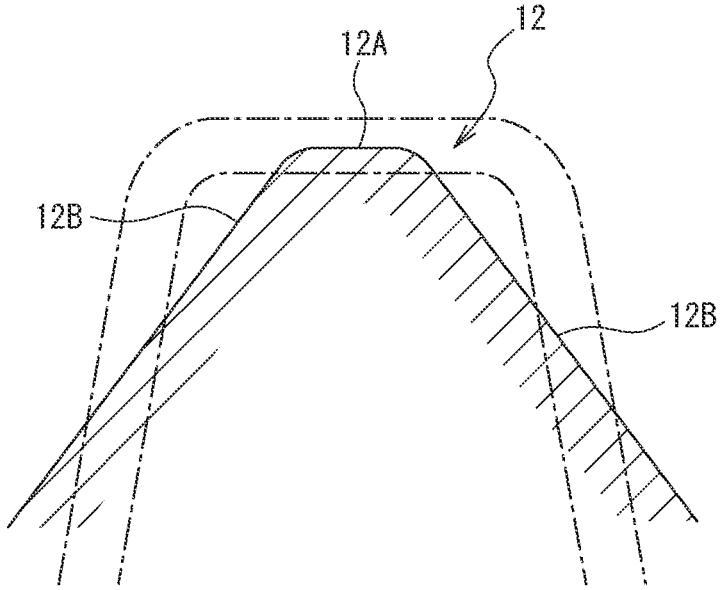
FIG. 10 illustrates views illustrating modifications of a top portion of the mountain-like shape.
Figure 10B:
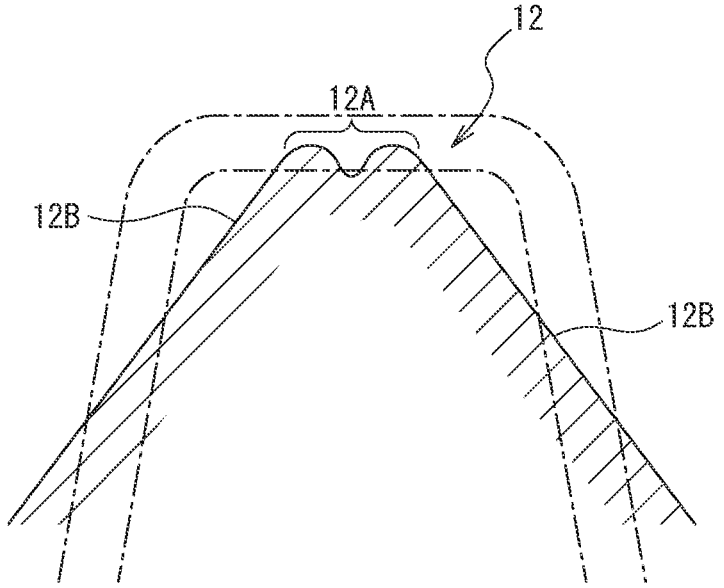

The description above describes a case where the cross-sectional shape of the top portion 12A is a circular arc shape projecting in the press direction as viewed from the longitudinal direction of the top sheet portion as an example. However, as illustrated in FIG. 10, the cross-sectional shape of the top portion 12A may be flat (see FIG. 10A). The cross-sectional shape of the top portion 12A may have irregularities (see FIG. 10B).

When the width of the top portion 12A is configured to be smaller than the width of the top sheet portion, the top portion 12A can be set to abut only the top sheet portion side constituting portion 1Ea. Therefore, the cross-sectional shape of the top portion 12A is not limited.

First Example

An example based on the first embodiment is described.

Herein, the manufacture of the press formed article 1 was evaluated assuming the saddle-shaped press formed article 1 of the shape illustrated in FIGS. 1 and 2.

As the metal sheet 2, a steel sheet of a steel type of SPFC980Y having a sheet thickness of 1.4 mm was adopted. As the dimensions of the press formed article 1, the width of the top sheet portion 1A was set to 84 mm and the height of the vertical wall portions 1C was set to 100 mm. Then, press forming (example of the invention) based on this embodiment and comparative press forming (comparative example) were carried out.

In the comparative example, pad forming (pad pressure: 15 ton) was carried out using an upper die and a lower die having the same forming surfaces as those of the target press formed article 1.

In the example, the punch angle $\alpha$ of the second lower die 12 was set to 90°. The contour shape of the slant surface 12B was set to a linear shape.

Figure 11:
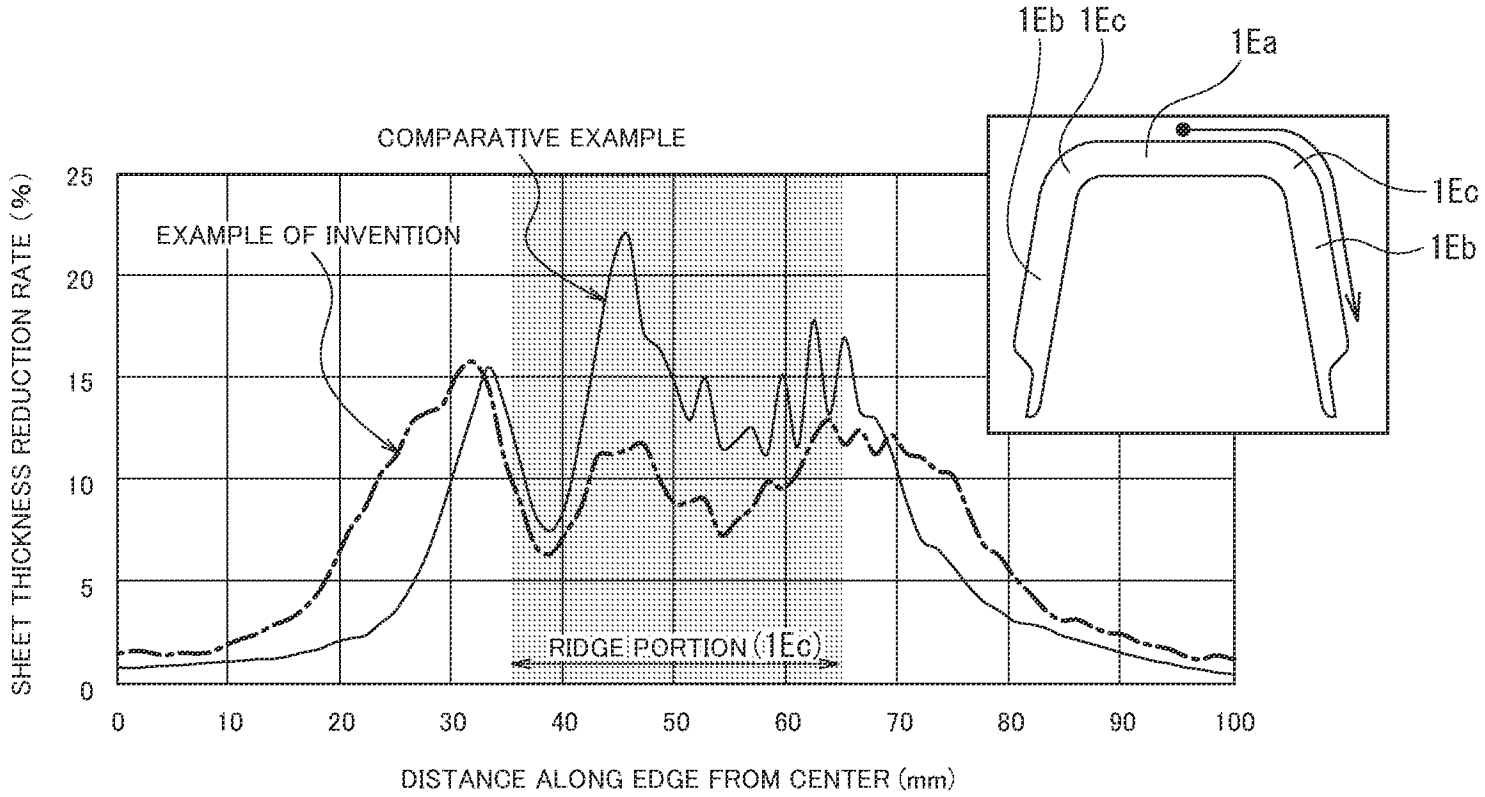
FIG. 11 is a view illustrating a distribution state of a sheet thickness reduction rate along the width direction of a top sheet portion in an example of the invention based on the embodiments and a comparative example.

FIG. 11 illustrates the analysis results. In FIG. 11, the ridge portions (1Ec) correspond to the ridge portion side areas. In FIG. 11, the horizontal axis indicates the distance in the width direction to the top sheet portion 1A with the position continuous to the center portion in the width direction of the top sheet portion 1A as the starting point. The same applies to FIG. 12 described later.

As is understood from FIG. 11, the strain is distributed in a wide range in the width direction of the top sheet portion 1A in the example of the invention as compared with the comparative example. Then, it was found that the sheet thickness reduction rate in the ridge portion side areas 1Ec as the corner portions was further reduced in the example of the invention.

Further, in the example of the invention, the punch angle $\alpha$ of the second lower die 12 was changed, and the effects thereof was evaluated.

Figure 12:
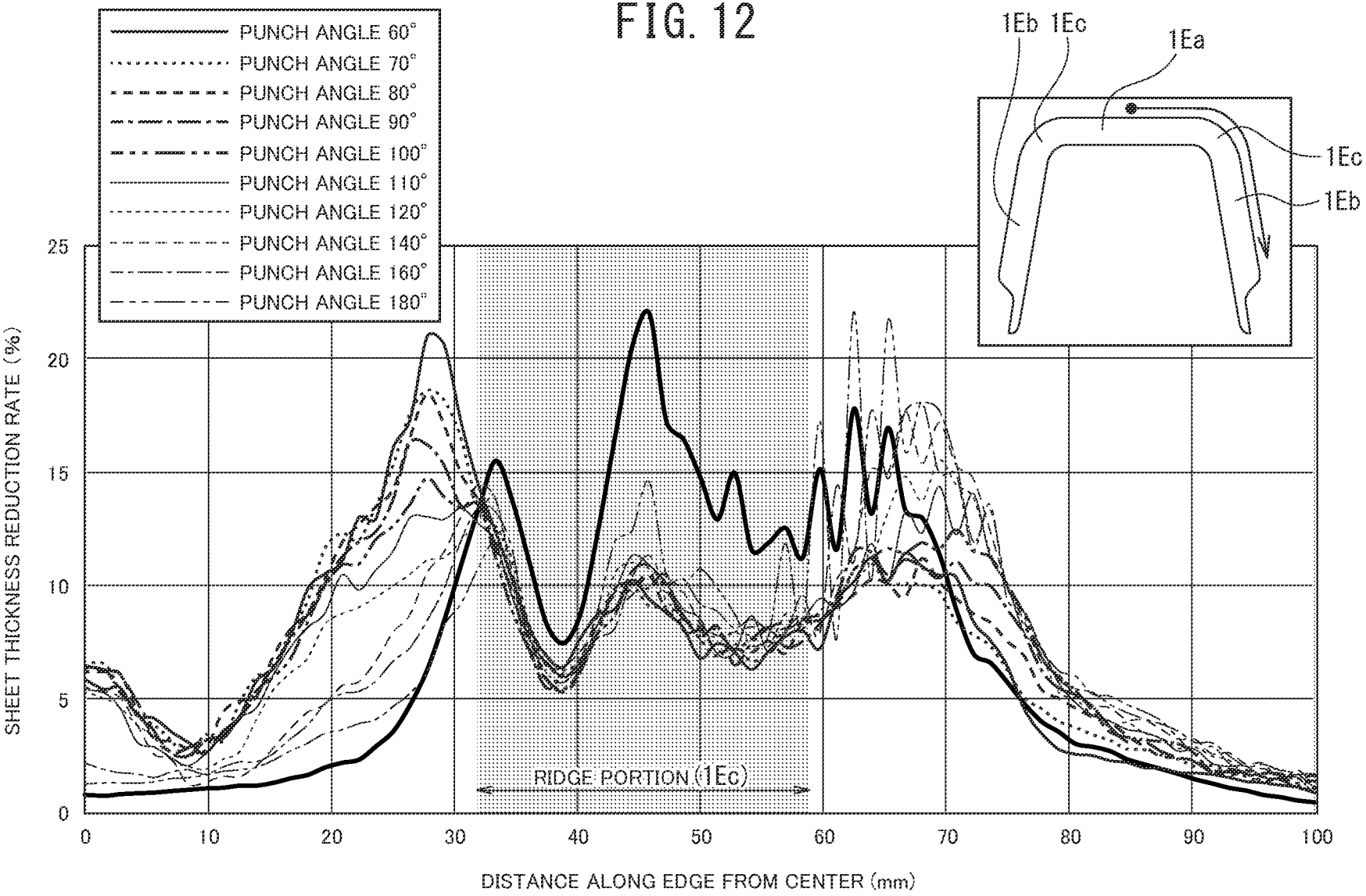
FIG. 12 is a view illustrating a distribution state of the sheet thickness reduction rate along the width direction of the top sheet portion at a plurality of punch angles.

FIG. 12 illustrates the analysis results.

As is understood from FIG. 12, it was confirmed that, even when the punch angle $\alpha$ was changed from 90° to the acute angle side or the obtuse angle side, an improvement effect of the sheet thickness reduction rate in the ridge portion side areas 1Ec is the same as the effect when the punch angle α was 90°. FIG. 12 illustrates cases where the punch angles α are 60° to 180°. As illustrated in FIG. 12, it is also confirmed that, even when the punch angle α was set to 60° and 180°, the improvement tendency of the sheet thickness reduction rate in the ridge portion side areas 1Ec as the corner portions is the same as that in the case of 90°.

Figure 13:
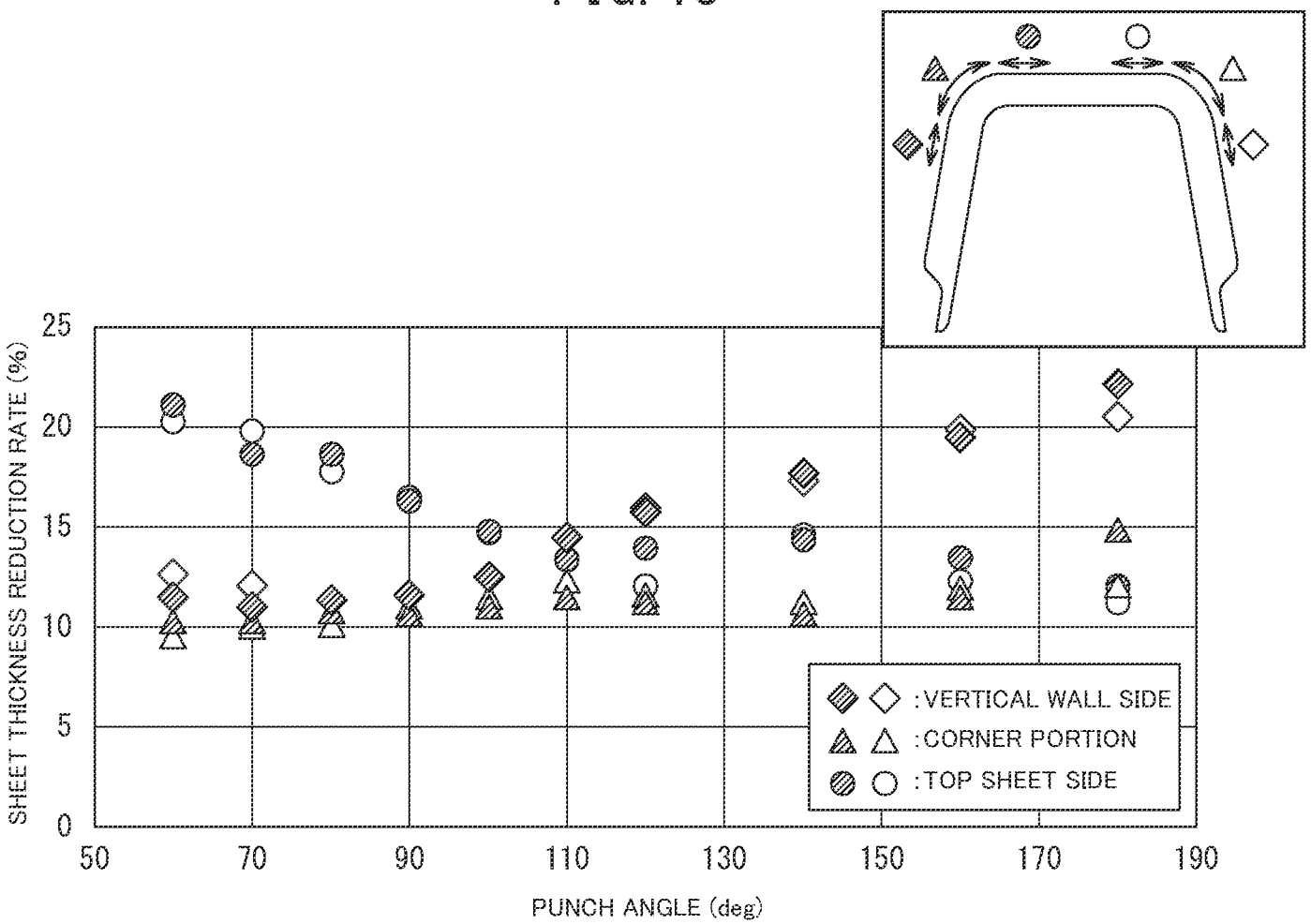
FIG. 13 is a view illustrating the relationship between the punch angles and the sheet thickness reduction rates.

FIG. 13 is a view in which the changes in the sheet thickness reduction rate in the ridge portion side areas 1Ec and areas near the ridge portion side areas 1Ec (vertical wall portion side constituting portions 1Eb sides and top sheet portion side constituting portion 1Ea side) due to the change in the punch angle α were determined. As is understood from FIG. 13, the maximum sheet thickness reduction rate is the smallest when the punch angle α is around 110°. The more acute angle the punch angle α becomes, the larger the sheet thickness reduction rate on the top sheet portion side constituting portion 1Ea side. Conversely, the more obtuse angle the punch angle α becomes, the larger the sheet thickness reduction rate on the vertical wall portion side constituting portion 1Eb side. This showed that the punch angle α is preferably 80° to 140°. The punch angle α is more preferably 90° to 120° and still more preferably 100° to 110°.

Second Example

An example based on the second embodiment is described.

Herein, the manufacture of the press formed article 1 was evaluated assuming the saddle-shaped press formed article 1 of the shape illustrated in FIGS. 1 and 2.

As the metal sheet 2, a steel sheet of a steel type of SPFC980Y having a sheet thickness of 1.4 mm was adopted. As the dimensions of the press formed article 1, the width of the top sheet portion 1A was set to 84 mm and the height of the vertical wall portions 1C was set to 100 mm. Then, press forming (example of the invention) based on this embodiment and comparative press forming (comparative example) were carried out.

In the comparative example, pad forming (pad pressure: 15 ton) was carried out using an upper die and a lower die having the same forming surface as those of the target press formed article 1.

In the example, the punch angle α of the second lower die 12 was set to 90°.

Figure 14:
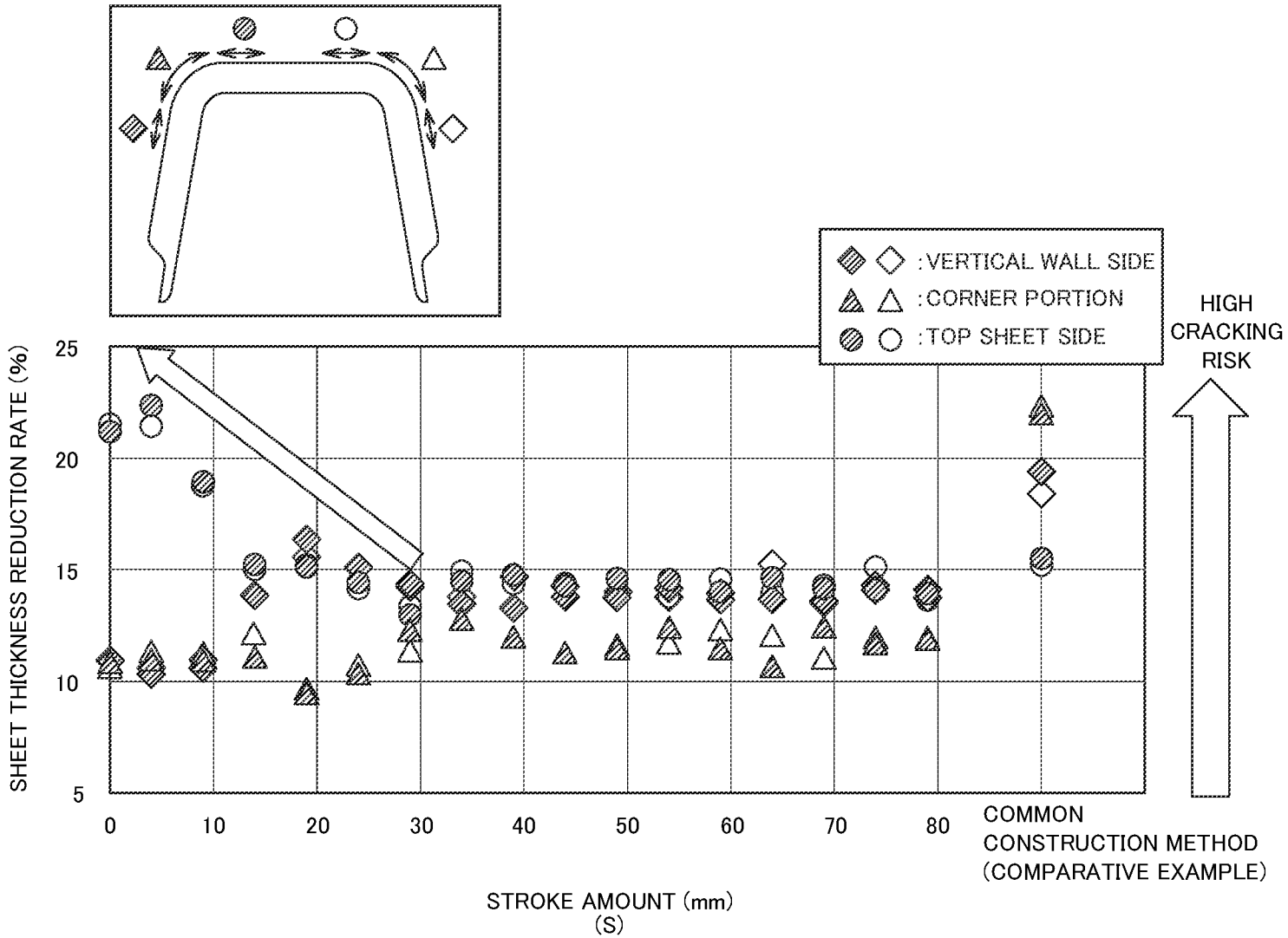
FIG. 14 is a view illustrating the relationship between the strokes of the second lower die and the sheet thickness reduction rates.

FIG. 14 illustrates the analysis results. In FIG. 14, the horizontal axis indicates the stroke amount S (see FIG. 7) stroking the first lower die 11 upward from the initial position (see FIG. 3) for the first step.

In FIG. 14, a state was formed in which, when the stroke amount S was set to 79 mm, the top portion 12A of the second lower die 12 contacts the metal sheet 2 in the forming of the metal sheet into the U-shape in cross section in the first step, but the bending forming was not started.

By making the stroke amount S small, the top portion 12A of the second lower die 12 is arranged in a state of protruding from the first lower die 11. Therefore, when the metal sheet 2 is formed into the U-shape in cross section, the forming amount of the outward flange portions 1E also increases.

On the other hand, in an area where the stroke amount S is smaller than 44 mm, the protrusion amount of the top portion 12A of the second lower die 12 increases, and the top sheet portion side constituting portion 1Ea was also partially formed simultaneously with the forming of the metal sheet 2 into the U-shape in cross section.

As is understood from FIG. 14, it was found that the sheet thickness reduction amount decreased irrespective of the stroke of the first lower die 11 in the ridge portion side areas 1Ec as the ridge portion side areas in the second embodiment as compared with a common construction method (comparative example). Further, it was able to be confirmed that, even when the stroke amount S was reduced to 29 mm, the sheet thickness reduction amount on the vertical wall portion side constituting portion 1Eb sides and the top sheet portion side constituting portion 1Ea sides did not deteriorate, and the strain was efficiently dispersed.

Figure 15:
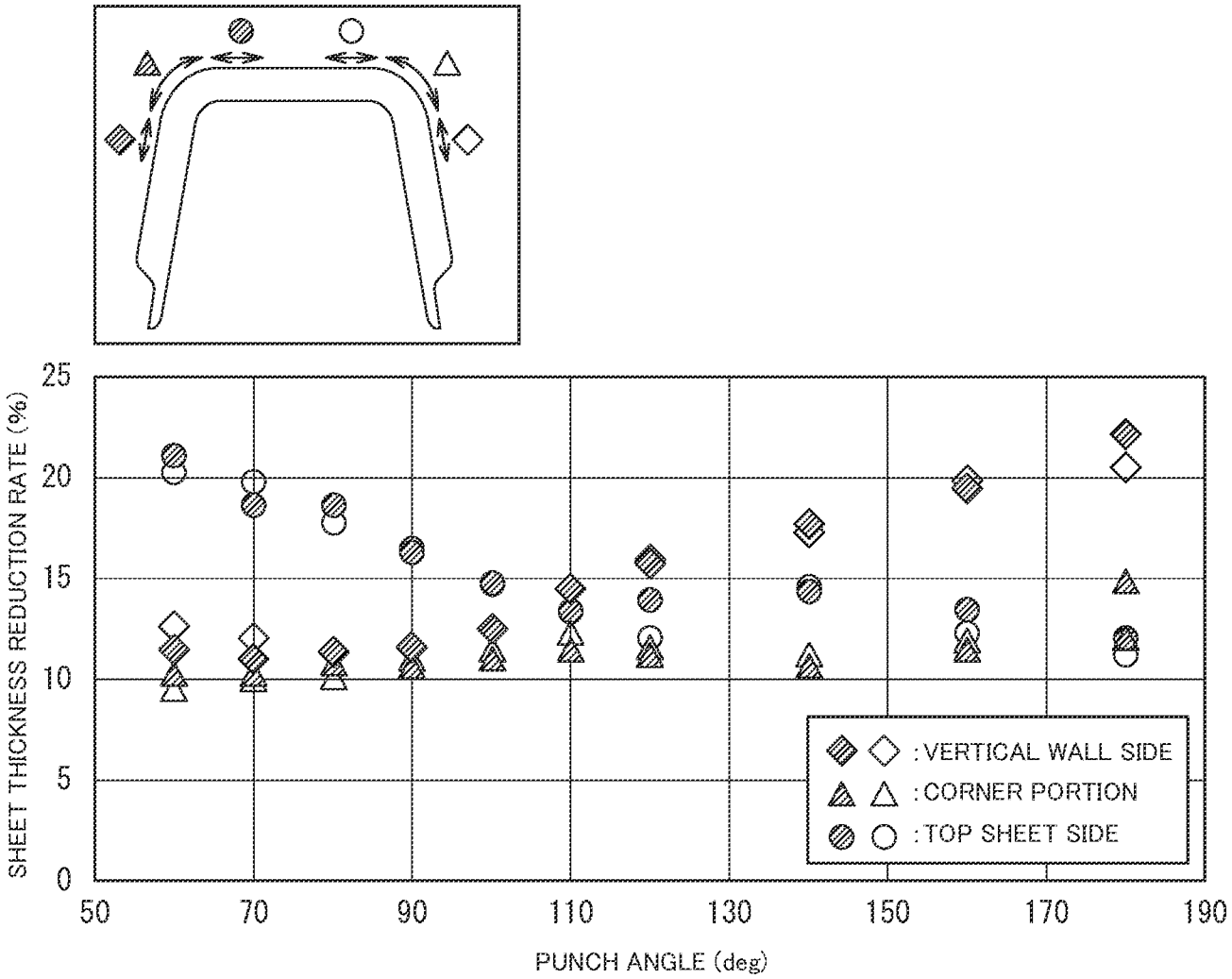
FIG. 15 is a view illustrating the relationship between the punch angles and the sheet thickness reduction rates.

FIG. 15 is a view in which the changes in the sheet thickness reduction rate in the ridge portion side areas 1Ec and areas near the ridge portion side areas 1Ec (vertical wall portion side constituting portions 1Eb sides and top sheet portion side constituting portion 1Ea side) due to the change in the punch angle α were determined. As is understood from FIG. 15, the maximum sheet thickness reduction rate is the smallest when the punch angle α is around 110°. The more acute angle the punch angle α becomes, the larger the sheet thickness reduction rate on the top sheet portion side constituting portion 1Ea side. Conversely, the more obtuse angle the punch angle α becomes, the larger the sheet thickness reduction rate on the vertical wall portion side constituting portion 1Eb side. This showed that the punch angle α is preferably 80° to 140°. The punch angle α is more preferably 90° to 120° and still more preferably from 100° to 110°.

To investigate the influence of the shape of the slant surfaces 12B of the second lower die 12 on the sheet thickness reduction of the flange portions 1E by carrying out only the second forming processing, analysis was also conducted for a curved shape in which the slant surfaces 12B are bent to protrude upward (FIG. 9B) and a curved shape in which the slant surfaces 12B are bent to protrude downward (FIG. 9C).

Figure 16:
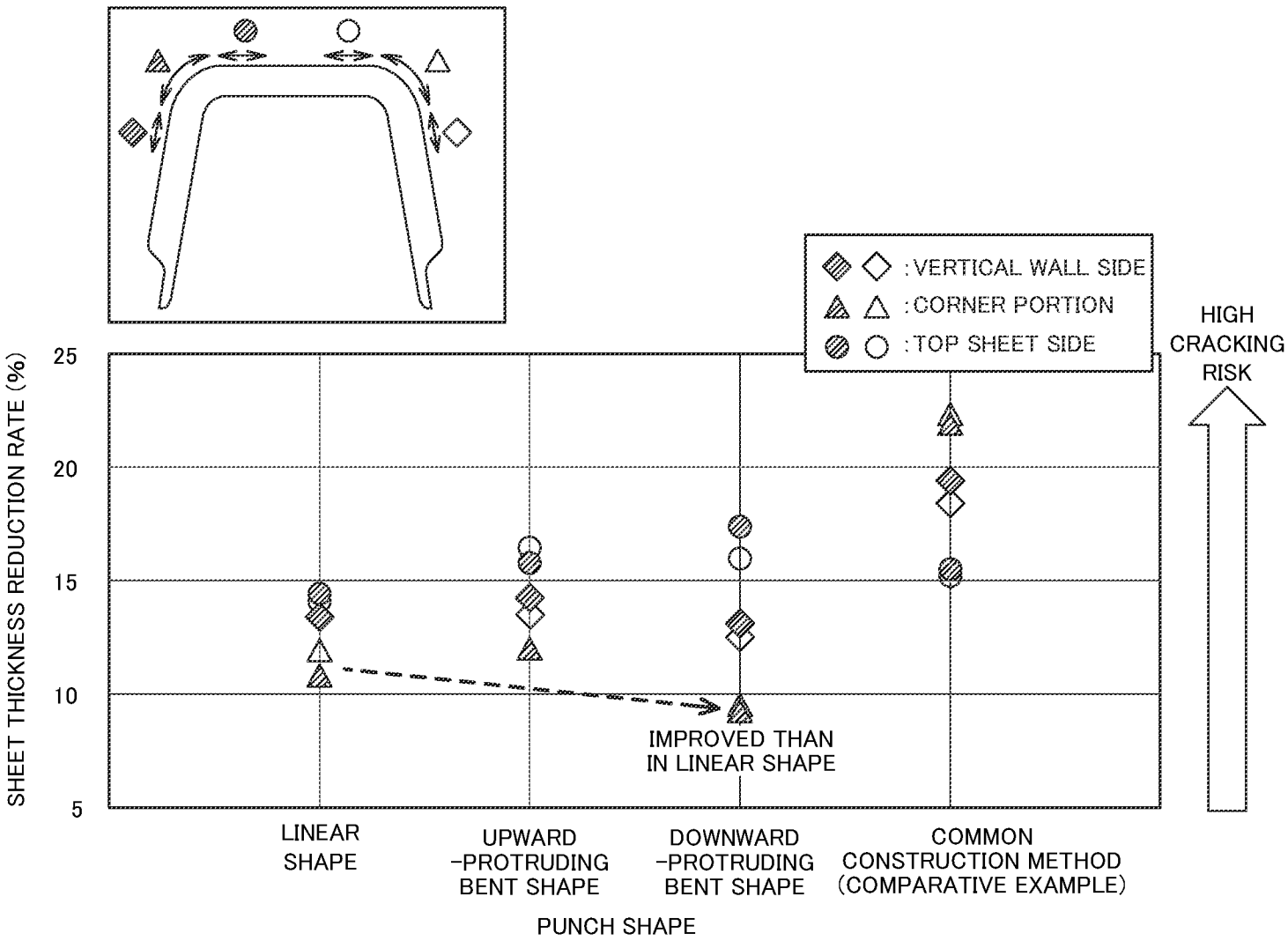
FIG. 16 is a view illustrating the relationship between the slant surface shapes of the second lower die and the sheet thickness reduction rates.

FIG. 16 illustrates the analysis results. It was found that the sheet thickness reduction amount decreased irrespective of the shape of the slant surfaces 12B in the ridge portion side areas 1Ec as compared with a common construction method (comparative example). It was also found that the sheet thickness reduction amount of the ridge portion side areas 1Ec as the corner portion further decreased in the shape where the slant surfaces 12B are bent to protrude downward than in the linear shape (FIG. 9A). Thus, when a strain distribution is uneven, the distribution degree can be adjusted by changing the shape of the slant surfaces 12B.

(Others)

This disclosure can also take the following configurations.

(1) A method for manufacturing a press formed article includes: when a press formed article is manufactured from a metal sheet, the press formed article including a top sheet portion, a vertical wall portion continuous to end portions in the width direction of the top sheet portion via a protruding ridge portion, and an outward flange portion continuous to longitudinal end portions of the top sheet portion, longitudinal end portions of the protruding ridge portion, and longitudinal end portions of the vertical wall portion via a recessed ridge portion, bending the metal sheet at the position of the protruding ridge portion and forming the metal sheet into an L-shape in cross section, and bending the metal sheet at the position of the recessed ridge portion and forming the outward flange portion after the forming of the L-shape in cross section or during the forming of the L-shape in cross section.

(2) The outward flange portion is formed after the forming of the L-shape in cross section, and the processing of bending the metal sheet at the position of the protruding ridge portion and forming the metal sheet into the L-shape in cross section is carried out in a state where an area to be the outward flange portion is released.

According to this configuration, the application of a strain to the area to be the outward flange portion when the metal sheet is formed into the L-shape in cross section can be suppressed to a low degree.

(3) The processing of forming the outward flange portion is carried out in a state where the top sheet portion and the vertical wall portion are restrained in the L-shape in cross section.

According to this configuration, the first step and the second step can be carried out by one press forming.

(4) In bending the metal sheet at the position of the recessed ridge portion and forming the outward flange portion, the application of a bending force is started to an area continuous to the longitudinal end portions of the top sheet portion and an area continuous to the longitudinal end portions of the vertical wall portion via the recessed ridge portion of the area to be the outward flange portion, and then the bending force is applied to the area continuous to the longitudinal end portions of the protruding ridge portion via the recessed ridge portion.

At this time, for the bending force to be applied to the area continuous to the longitudinal end portions of the top sheet portions via the recessed ridge portion, a first bending force is preferably applied to a position 0 mm or more away from the ends of the protruding ridge portion. The "from the ends of the protruding ridge portion" means "from the end positions (boundaries with other portions) of the radius of the protruding ridge portion containing a circular arc-shaped cross section or the like".

According to this configuration, a strain (sheet thickness reduction rate) distributed to the recessed ridge portion 1D (corner part) in the outward flange portion can be more reliably suppressed to a low degree (see FIG. 11).

The forming of the recessed ridge portion 1D is carried out after the forming is started from a position away from the recessed ridge portion 1D in the outward flange portion as described in the embodiments.

(5) A method for manufacturing a press formed article includes: when a press formed article is manufactured from a metal sheet, the press formed article including a top sheet portion, a vertical wall portion continuous to end portions in the width direction of the top sheet portion via a protruding ridge portion, and an outward flange portion continuous to longitudinal end portions of the top sheet portion, longitudinal end portions of the protruding ridge portion, and longitudinal end portions of the vertical wall portion via a recessed ridge portion, bending the metal sheet at the position of the protruding ridge portion and forming the metal sheet into an L-shape in cross section and bending the metal sheet at the position of the recessed ridge portion and forming the outward flange portion in bending the metal sheet at the position of the recessed ridge portion and forming the outward flange portion, starting the application of a bending force to an area continuous to the longitudinal end portions of the top sheet portion and an area continuous to the longitudinal end portions of the vertical wall portion via the recessed ridge portion of an area to be the outward flange portion, and then applying the bending force to the area continuous to the longitudinal end portions of the protruding ridge portion via the recessed ridge portion; and after the completion of the forming of the L-shape in cross section, completing the forming of the area continuous to the longitudinal end portions of the protruding ridge portion via the recessed ridge portion in the outward flange portion.

For the bending force to be applied to the areas continuous to the longitudinal end portions of the top sheet portions via the recessed ridge portion, a first bending force is preferably applied to a position 0 mm or more and preferably 3 mm or more away from the ends of the protruding ridge portion. The "from the protruding ridge portion" means "from the end positions of the radius of the protruding ridge portion of a circular arc-shaped cross section".

According to this configuration, the strain (sheet thickness reduction rate) distributed to the recessed ridge portion 1D (corner part) in the outward flange portion can be more reliably suppressed to a low degree (see FIG. 8).

The forming of the recessed ridge portion 1D is carried out after the forming is started from a position away from the recessed ridge portion 1D in the outward flange portion as described in the embodiments.

(6) For the bending force to be applied to the area continuous to the longitudinal end portion of the top sheet portion via the recessed ridge portion, a first bending force is applied to a position located inside the protruding ridge portion.

According to this configuration, the strain (sheet thickness reduction rate) distributed to the recessed ridge portion 1D (corner part) in the outward flange portion can be more reliably suppressed to a low degree.

(7) The shape of the press formed article includes a top sheet portion, right and left vertical wall portion continuous to both sides in the width direction of the top sheet portion via right and left protruding ridge portions, and outward flange portions continuous to longitudinal end portions of the top sheet portion, longitudinal end portions of the right and left protruding ridge portions, and longitudinal end portions of the right and left vertical wall portions via recessed ridge portions.

According to this configuration, a saddle-shaped pressed article is manufactured.

(8) A press forming device for manufacturing, from a metal sheet, a press formed article including a top sheet portion, a vertical wall portion continuous to end portions in the width direction of the top sheet portion via a protruding ridge portion, and an outward flange portion continuous to longitudinal end portions of the top sheet portion, longitudinal end portions of the protruding ridge portion, and longitudinal end portions of the vertical wall portion via a recessed ridge portion, and the press forming device includes:

a first upper die and a first lower die having forming surfaces capable of forming areas to be the top sheet portion and the vertical wall portion at a position where the protruding ridge portion is formed and forming the top sheet portion and the vertical wall portion continuous to the top sheet portion; and a second lower die bending the metal sheet at the recessed ridge portion and forming the outward flange portion, in which a forming surface in a part where a bending force is applied to an area to be the outward flange portion and the outward flange portion is formed in the second lower die includes, as viewed from the longitudinal direction of the top sheet portion, a top portion and a pair of slant surfaces continuous to both the right and left sides of the top portion and have a mountain-like shape protruding in the bending direction of the outward flange portion as a whole, and the top portion of the mountain-like shape is set to be able to abut on an area continuous to the longitudinal end portions of the top sheet portion via the recessed ridge portion of the area to be the outward flange portion.

According to this configuration, the width of the corner part of the outward flange portion as the flange portion located in the longitudinal end portions can be set large.

Figure 17:
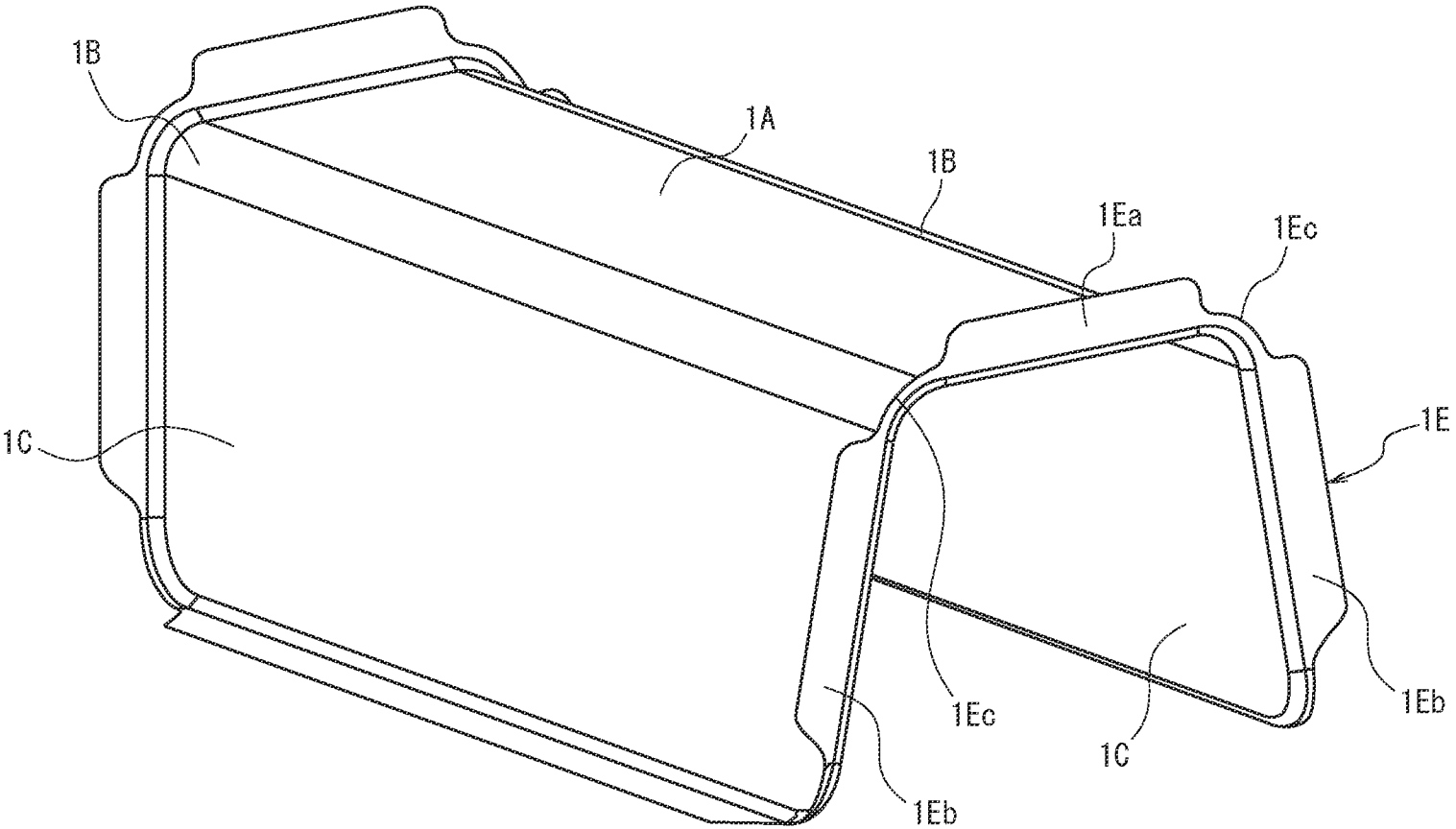
FIG. 17 is a perspective view illustrating another example of a press formed article.

Further, it is not necessary to perform cut-out such that the width of the outward flange portion corner constituting portion 1Ec is small as illustrated in FIG. 17, for example. Even when the width is set to the same width as that of the other parts as illustrated in FIG. 1, the generation of cracks and the like can be suppressed.

(9) A press forming device includes a second upper die facing the second lower die in the press direction, in which the metal sheet formed by the second lower die is the metal sheet which has been subjected to the forming by the first upper die and the first lower die.

(10) The first upper die and the second upper die are constituted by one upper die, and the first lower die and the second lower die are arranged in a state of being offset in the longitudinal direction of the top sheet portion.

According to this configuration, the forming up to the outward flange portion can be performed by one press working.

(11) The first lower die and the second lower die are arranged in a state of being offset in the longitudinal direction of the top sheet portion and the first lower die can be stroked in the direction along the press direction with respect to the second lower die.

According to this configuration, the forming up to the outward flange portion can be performed by one press working.

Further, the stroke amount of the first lower die can be suppressed to a small amount.

(12) The mountain-like shape has a punch angle formed by the crossing angle connecting right and left slant surfaces forming the mountain-like shape wider than twice an angle obtained by subtracting 90° from an angle formed by the top sheet portion and the vertical wall portion in the metal sheet formed by the first upper die and the first lower die.

According to this configuration, the setting is performed such that the forming is started from a lower end portion of a vertical wall portion side constituting portion in the outward flange portion, and then the forming is started from a center portion of the top sheet portion side constituting portion by the second lower die, so that the forming position is moved toward the corner constituting portions.

According to this configuration, the strain (sheet thickness reduction rate) distributed to the recessed ridge portion 1D (corner part) in the outward flange portion can be more reliably suppressed to a low degree (see FIG. 11).

(13) The punch angle is in the range of 60° or more and 180° or less.

(14) The contour shape of the slant surfaces in the mountain-like shape is in a curved shape protruding in a direction opposite to the press direction along the slant direction of the slant surfaces.

According to this configuration, the sheet thickness reduction amount of the corner portions can be set small depending on the strain degree.

(15) A manufacturing method for manufacturing the press formed article from a metal sheet using the press forming device of this disclosure includes:

press forming areas to be the top sheet portion and the vertical wall portion in the metal sheet into an L-shape in cross section using the first upper die and the first lower die; and forming the outward flange portion to the metal sheet press formed into the L-shape in cross section using the second upper die and the second lower die.

According to this configuration, the strain (sheet thickness reduction rate) distributed to the recessed ridge portion 1D (corner part) in the outward flange portion can be more reliably suppressed to a low degree.

(16) The outward flange portion is formed by the second upper die and the second lower die in a state where the metal sheet is restrained in the L-shape in cross section by the first upper die and the first lower die.

According to this configuration, the strain (sheet thickness reduction rate) distributed to the recessed ridge portion 1D (corner part) in the outward flange portion can be more reliably suppressed to a low degree.

(17) A manufacturing method for manufacturing the press formed article from a metal sheet using the press forming device of this disclosure includes:

partially forming the outward flange portion using the second lower die while the areas to be the top sheet portion and the vertical wall portion in the metal sheet are press formed into an L-shape in cross section using the first upper die and the first lower die.

According to this configuration, the strain (sheet thickness reduction rate) distributed to the recessed ridge portion 1D (corner part) in the outward flange portion can be more reliably suppressed to a low degree.

Herein, the entire contents of JP 2020-148121 A (filed Sep. 3, 2020) and JP 2021-047187A (filed Mar. 22, 2021), for which this application claims priority, form part of this disclosure by reference. Herein, the description is given with reference to a limited number of embodiments, but the scope of the invention is not limited thereto and modifications of each embodiment based on the disclosure above are obvious to those skilled in the art.

REFERENCE SIGNS LIST

1 press formed article
1A top sheet portion
1B protruding ridge portion
1C vertical wall portion
1D recessed ridge portion
1E outward flange portion
1Ea top sheet portion side area (top sheet portion side constituting portion)
1Eb vertical wall portion side area (vertical wall portion side constituting portion)
1Ec ridge portion side area (corner constituting portion)
2 metal sheet
10 upper die (first upper die, second upper die)
11 first lower die
12 second lower die
12A top portion
12B slant surface
α angle of second lower die

The invention claimed is:

1. A method for manufacturing a press formed article from a metal sheet, the press formed article including a top sheet portion, a vertical wall portion continuous to end portions in a width direction of the top sheet portion via a protruding ridge portion, and an outward flange portion continuous to longitudinal end portions of the top sheet portion, longitudinal end portions of the protruding ridge portion, and longitudinal end portions of the vertical wall portion via a recessed ridge portion, the method comprising:

bending the metal sheet at a position where the protruding ridge portion is to be formed and forming the metal sheet into an L-shape in cross section in order to form the top sheet portion, the vertical wall portion and the protruding ridge portion; and bending the metal sheet at a position where the recessed ridge portion is to be formed and forming the outward flange portion in order to form the outward flange portion and the recessed ridge portion after the forming of the L-shape in cross section, wherein:

the bending of the metal sheet at the position where the protruding ridge portion is to be formed and the forming the metal sheet into the L-shape in cross section is carried out in a state where an area of the metal sheet to be formed into the outward flange portion is released.

2. The method for manufacturing the press formed article according to claim 1, the forming of the outward flange portion is carried out in a state where the top sheet portion and the vertical wall portion are restrained in the L-shape in cross section.

3. The method for manufacturing the press formed article according to claim 1, wherein in the bending of the metal sheet at the position where the recessed ridge portion is to be formed and forming the outward flange portion:

starting an application of a bending force to an area of the metal sheet continuous to the longitudinal end portions of the top sheet portion and to an area of the metal sheet continuous to the longitudinal end portions of the vertical wall portion, then later applying the bending force to the area of the metal sheet continuous to the longitudinal end portions of the protruding ridge portion.

4. The method for manufacturing the press formed article according to claim 3, wherein, for the bending force to be applied to the area of the metal sheet continuous to the longitudinal end portions of the top sheet portion, a first bending force is applied to a position located inside the protruding ridge portion.

5. The method for manufacturing the press formed article according to claim 1, wherein a shape of the press formed article includes the top sheet portion, right and left vertical wall portions that includes the vertical wall portion and that are continuous to both sides in a width direction of the top sheet portion via right and left protruding ridge portions that includes the protruding ridge portion, and outward flange portions that includes the outward flange portion and that are continuous to longitudinal end portions of the top sheet portion, longitudinal end portions of the right and left protruding ridge portions, and longitudinal end portions of the right and left vertical wall portions via recessed ridge portions that include the recessed ridge portion.

6. A method for manufacturing a press formed article from a metal sheet, the press formed article including a top sheet portion, a vertical wall portion continuous to end portions in a width direction of the top sheet portion via a protruding ridge portion, and an outward flange portion continuous to longitudinal end portions of the top sheet portion, longitudinal end portions of the protruding ridge portion, and longitudinal end portions of the vertical wall portion via a recessed ridge portion, the method comprising:

bending the metal sheet at a position where the protruding ridge portion is to be formed and forming the metal sheet into an L-shape in cross section in order to form the top sheet portion, the vertical wall portion and the protruding ridge portion; and bending the metal sheet at a position where the recessed ridge portion is to be formed and forming the outward flange portion and the recessed ridge portion, wherein:

in the bending of the metal sheet at the position where the recessed ridge portion is to be formed and forming the outward flange portion:

starting an application of a bending force to an area of the metal sheet continuous to the longitudinal end portions of the top sheet portion and to an area continuous to the longitudinal end portions of the vertical wall portion, and applying the bending force to the area of the metal sheet continuous to the longitudinal end portions of the protruding ridge portion only after starting the application of the bending force to the area of the metal sheet continuous to the longitudinal end portions of the top sheet portion and to the area continuous to the longitudinal end portions of the vertical wall portion; and after completion of the forming of the L-shape in cross section, completing the forming of the area of the metal sheet continuous to the longitudinal end portion of the protruding ridge portion.

7. The method for manufacturing the press formed article according to claim 6, wherein, for the bending force to be applied to the area of the metal sheet continuous to the longitudinal end portions of the top sheet portion, a first bending force is applied to a position located inside the protruding ridge portion.

8. The method for manufacturing the press formed article according to claim 6, wherein a shape of the press formed article includes the top sheet portion, right and left vertical wall portions that includes the vertical wall portion and that are continuous to both sides in a width direction of the top sheet portion via right and left protruding ridge portions that includes the protruding ridge portion and outward flange portions that includes the outward flange portion and that are continuous to longitudinal end portions of the top sheet portion, longitudinal end portions of the right and left protruding ridge portions, and longitudinal end portions of the right and left vertical wall portions via recessed ridge portions that include the recessed ridge portion.

9. A press forming device for manufacturing, from a metal sheet, a press formed article including a top sheet portion, a vertical wall portion continuous to end portions in a width direction of the top sheet portion via a protruding ridge portion, and an outward flange portion continuous to longitudinal end portions of the top sheet portion, longitudinal end portions of the protruding ridge portion, and longitudinal end portions of the vertical wall portion via a recessed ridge portion, the press forming device comprising:

a first upper die and a first lower die having forming surfaces that are configured to form areas to be the top sheet portion and the vertical wall portion at a position where the protruding ridge portion is to be formed and configured to form the top sheet portion and the vertical wall portion continuous to the top sheet portion; and a second lower die that is configured to bend the metal sheet at a position where the recessed ridge portion is to be formed and configured to form the outward flange portion, wherein the second lower die is configured to include, when viewed from a longitudinal direction of the top sheet portion, a top portion and a pair of slant surfaces continuous to both right and left sides of the top portion in order to form one continuous surface and have a protruding shape configured to protrude in a bending direction of the outward flange portion to be formed as a whole, an entire portion of the top portion is rounded; and the top portion of the protruding shape is configured to be able to abut on an area of the metal sheet continuous to the longitudinal end portions of the top sheet portion in order to form the outward flange portion.

10. The press forming device according to claim 9 comprising:

a second upper die facing the second lower die in a press direction, wherein the second lower die is configured such that the metal sheet formed by the second lower die is the metal sheet which has been subjected to the forming by the first upper die and a first lower die.

11. The press forming device according to claim 10, wherein the first upper die and the second upper die are constituted by one upper die, and the first lower die and the second lower die are configured to be arranged in a state of being offset in the longitudinal direction of the top sheet portion.

12. A method for manufacturing the press formed article using the press forming device according to claim 10, the method comprising:

press forming the areas of the metal sheet to be the top sheet portion and the vertical wall portion in the metal sheet into an L-shape in cross section in order to form the top sheet portion, the vertical wall portion and the protruding ridge portion using the first upper die and the first lower die; and forming the outward flange portion to the metal sheet press formed into the L-shape in cross section using the second upper die and the second lower die.

13. The method for manufacturing the press formed article according to claim 12, comprising forming the outward flange portion by the second upper die and the second lower die in a state where the metal sheet is restrained in the L-shape in cross section by the first upper die and the first lower die.

14. The press forming device according to claim 9, wherein the first lower die and the second lower die are configured to be arranged in a state of being offset in the longitudinal direction of the top sheet portion to be formed and the first lower die can be stroked in a direction along the press direction with respect to the second lower die.

15. A method for manufacturing the press formed article using the press forming device according to claim 14, the method comprising:

partially forming the outward flange portion using the second lower die while the areas to be the top sheet portion and the vertical wall portion in the metal sheet are press formed into an L-shape in cross section in order to form the top sheet portion, the vertical wall portion and the protruding ridge portion using the first upper die and the first lower die.

16. The press forming device according to claim 9, wherein the protruding shape is configured to have a punch angle formed by a crossing angle connecting the pair of slant surfaces forming the protruding shape wider than twice an angle obtained by subtracting 90° from an angle formed by the top sheet portion and the vertical wall portion formed by the first upper die and the first lower die.

17. The press forming device according to claim 16, wherein the punch angle is in a range of 60° or more and 180° or less.

18. The press forming device according to claim 9, wherein a contour shape of the pair of slant surfaces in the protruding shape is in a curved shape protruding in a direction opposite to the press direction along a slant direction of the pair of slant surfaces.

19. A method for manufacturing the press formed article using the press forming device according to claim 9, the method comprising:

partially forming the outward flange portion using the second lower die while the areas to be the top sheet portion and the vertical wall portion in the metal sheet are press formed into an L-shape in cross section in order to form the top sheet portion, the vertical wall portion and the protruding ridge portion using the first upper die and the first lower die.

* * * * *